US006357739B2

(12) United States Patent
Sasaki et al.

(10) Patent No.: US 6,357,739 B2
(45) **Date of Patent: *Mar. 19, 2002**

(54) RECORDING SHEET PACKAGE AND SHEET SUPPLY CASSETTE FOR PRINTER

(75) Inventors: Hidemi Sasaki; Akimasa Kaya; Takeshi Fujishiro; Shuusuke Mogi, all of Saitama; Yoshio Ishiduka, Kanagawa, all of (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/291,211

(22) Filed: Apr. 14, 1999

(30) Foreign Application Priority Data

| | | |
|---|---|---|
| Apr. 14, 1998 | (JP) | 10-102958 |
| May 8, 1998 | (JP) | 10-126368 |
| May 11, 1998 | (JP) | 10-127869 |
| May 21, 1998 | (JP) | 10-140237 |

(51) Int. Cl.[7] ..... B65H 1/00

(52) U.S. Cl. ..... 271/145; 271/127; 271/240; 271/241

(58) Field of Search ..... 271/126, 127, 271/241, 240, 238, 233, 145, 162, 171; 378/182, 184, 187; 396/512, 516; 206/449

(56) References Cited

U.S. PATENT DOCUMENTS

| | | | | |
|---|---|---|---|---|
| 3,360,258 A | * | 12/1967 | Nix | 206/449 |
| 4,030,725 A | * | 6/1977 | Fukui et al. | 271/171 |
| 4,349,186 A | | 9/1982 | Nakamura | 271/18 |
| 4,388,992 A | | 6/1983 | Deconinck | 206/455 |
| 4,531,878 A | | 7/1985 | Tamura | 414/412 |
| 4,537,307 A | * | 8/1985 | Tamura | 271/145 |
| 5,026,039 A | * | 6/1991 | Kuzuya et al. | 271/171 |
| 5,120,044 A | | 6/1992 | Ettischer et al. | 271/127 |
| 5,137,269 A | * | 8/1992 | Yamamoto | 271/145 |
| 5,314,179 A | * | 5/1994 | Oda et al. | 271/145 |
| 5,560,597 A | * | 10/1996 | Bailey et al. | 271/145 |
| 5,687,965 A | * | 11/1997 | Matsuda et al. | 271/162 |
| 5,944,306 A | | 8/1999 | Maeda et al. | 271/145 |

FOREIGN PATENT DOCUMENTS

| | | | | |
|---|---|---|---|---|
| EP | 0 280 053 A2 | | 8/1988 | G03B/42/04 |
| EP | 0 768 566 A2 | | 4/1997 | G03B/42/04 |
| JP | 0007634 | * | 1/1984 | 271/145 |
| JP | 403088630 A | * | 4/1991 | 271/145 |
| JP | 5-116774 | | 5/1993 | B65H/1/26 |
| JP | 9-132277 | | 5/1997 | B65D/81/24 |
| JP | 9-132330 | | 5/1997 | B65H/1/26 |

OTHER PUBLICATIONS

Japanese Abstract No. 57107339.
Communication of a Foreign Office Action.

* cited by examiner

*Primary Examiner*—H. Grant Skaggs
(74) *Attorney, Agent, or Firm*—Sughrue Mion, PLLC

(57) ABSTRACT

A thermal printer includes a thermal printer component for image recording to a thermosensitive recording sheet. There is a loading opening through which the thermal printer component is supplied with the recording sheet. Plural guiding projections position the recording sheet in the loading opening. A recording sheet package includes a packaging case for containing a loose stack of plural recording sheets. The loading opening is loadable with the packaging case. A package outlet is formed in the packaging case for passage of each recording sheet, and set directed toward the thermal printer component. Plural cutouts are formed in a periphery of the packaging case, and receive the guiding projections. Blocking portions of a blocking frame are disposed inside the packaging case, and close the cutouts. The blocking portions are shiftable inwards from the cutouts by the guiding projections.

5 Claims, 39 Drawing Sheets

RECORDING SHEET PACKAGE AND SHEET SUPPLY CASSETTE FOR PRINTER

BACKGROUND OF THE INVENTION

1. Field of the Invention

The present invention relates to a recording sheet package and a sheet supply cassette for a printer. More particularly, the present invention relates to a recording sheet package in which a stack of recording sheets can be contained in a state protected from ambient light and moisture, and a sheet supply cassette for a printer.

2. Description Related to the Prior Art

There are two types of thermal printer, including a direct thermal printing type and a thermal transfer type, for each of which a recording sheet of a predetermined type is used. The recording sheet for the direct thermal printing is constituted by a support and three thermosensitive coloring layers overlaid thereon, which are cyan, magenta and yellow coloring layers. Heat energy of three values is applied to the recording sheet to develop colors of each of the coloring layers. Each coloring layer after being heated is optically fixed prior to thermal recording of a succeeding one of the coloring layers. For this optical fixation, ultraviolet rays of a predetermined range of the wavelength are applied to the recording sheet to destroy the coloring ability of each coloring layer. The succeeding coloring layer can be safely heated without influencing the density of the color developed in the preceding coloring layer. If the recording sheet of the direct thermal printing type is kept subjected to light from lamps as widely used appliances for light source, the coloring ability of the recording sheet is remarkably influenced. Consequently a stack of recording sheets is contained in a light-tight packaging bag, and furthermore contained in a cardboard box to be shipped commercially.

There are two types of thermal transfer printer, including a wax-transfer type and a sublimation type. The waxtransfer printer melts or softens ink of ink film, and transfers it to the recording sheet. The sublimation printer sublimates or disperses dye of ink film on to the recording sheet. The recording sheet for the wax-transfer printer consists of coated paper having high smoothness. The recording sheet for the sublimation printer consists of paper coated with polyester resin. For both of the thermal transfer printers, a plurality of recording sheets are stacked and contained in a moisture proof bag, which is then contained in a cardboard box to be shipped for sale.

A recording sheet package is used for easy handling of a stack of the recording sheets. To load the printer with the recording sheets, at first a packaging bag is opened to remove the recording sheet package, which is inserted in a sheet supply cassette. The sheet supply cassette is set in the printer. Thus the loading of the recording sheets is complicated to most of the users. While a user manually removes the recording sheets from the packaging bag, it is likely that the recording sheets are exposed to ambient light and touched by the user's hand. In the case of the recording sheets for the thermal transfer printing, touched portions are discolored by fingerprints. In the case of the recording sheets for the direct thermal printing, the coloring ability of the uppermost one of the recording sheets is influenced by the ambient light.

JP-A 5-116774 discloses the recording sheet package in which the recording sheets are not touched directly by user's hand, and with which the printer can be easily loaded with the recording sheets. A cutting line with a train of perforations is formed in a body of the recording sheet package. A portion of the body of the recording sheet package is cut away by tearing the cutting line, to form an opening for removal of the recording sheets. The tearing requires a user's manual operation prior to the loading into the printer.

In the course of manufacturing a recording sheet package, it is difficult to insert a stack of recording sheets into a packaging case, because an ordinary type of recording sheet package accommodates the recording sheets in a state tightly contacted by the packaging case. Therefore, recording sheet packages, according to the prior art, have been manufactured by use of a process of wrapping the recording sheets in a packaging case. Another problem arises in that the tight contact of the packaging case with the recording sheets considerably raises the resistance to the advance of the recording sheets. There is no smoothness in the sheet advance.

It is conceivable to provide looseness between the packaging case and the recording sheet contained therein. However a further problem arises in that the recording sheets are not positioned stably in the packaging case. The printing may be degraded, as the recording sheets may advance obliquely or may be jammed.

JP-A 9-132330 discloses a sheet supply cassette in which air tight sponge members are disposed on joining edges where a cassette portion and a lid of the cassette are fitted when closed. This is for the purpose of protecting the recording sheets from being moistened.

However the lid of this sheet supply cassette must be opened in order to supply the recording sheets. Although the inside of the sheet supply cassette is kept with sufficient tightness when closed, the moisture-proofness is lowered at the time of the supply of the recording sheet.

SUMMARY OF THE INVENTION

In view of the foregoing problems, an object of the present invention is to provide a recording sheet package for a printer, wherein a stack of recording sheets can be contained in a state protected from ambient light and moisture, and a sheet supply cassette for the printer.

Another object of the present invention is to provide a recording sheet package for a printer, wherein the recording sheet package is capable of being mounted easily on the printer, and a sheet supply cassette for the printer.

Still another object of the present invention is to provide a recording sheet package for a printer, wherein recording sheets can be protected in the course of transportation and preservation, and a sheet supply cassette for the printer.

An additional object of the present invention is to provide a recording sheet package for a printer, wherein recording sheets can be advanced while positioned stably, and a sheet supply cassette for the printer.

In order to achieve the above and other objects and advantages of this invention, a recording sheet package is provided for a printer, the printer including a printer component for image recording to a recording sheet, a loading opening through which the printer component is supplied with the recording sheet, and at least one guiding member for positioning the recording sheet in the loading opening. The recording sheet package includes a packaging case for containing a stack of plural recording sheets with looseness, the loading opening being loadable with the packaging case. A package outlet is formed in the packaging case, passable to one of the recording sheets, and set directed toward the printer component. At least one cutout is formed in a periphery of the packaging case, for receiving the guiding member. At least one blocking mechanism is disposed inside the packaging case, for closing the cutout, the blocking mechanism being shiftable inwards from the cutout by the guiding member.

In a preferred embodiment, the blocking mechanism comprises an auxiliary bag, light-tight and moisture-proof, contained in the packaging case, for containing the stack of the recording sheets with looseness.

By this construction, the stack of recording sheets can be contained in a state protected from ambient light and moisture, because the cutout is reliably closed.

In another preferred embodiment, a sheet supply cassette is provided for a printer, the printer including a printer component for image recording to a recording sheet, a loading opening through which the recording sheet is inserted into the printer component, and a supply roller for supplying the printer component with the recording sheet. The sheet supply cassette includes a cassette body, loaded in the loading opening, for containing a stack of plural recording sheets with looseness. A cassette outlet is formed in the cassette body, passable to one of the recording sheets, and set directed toward the printer component. An insertion opening is formed in the cassette body, for receiving insertion of the supply roller, for allowing contact of the supply roller with one of the recording sheets. A bias mechanism presses the recording sheets against the supply roller by biasing the recording sheets.

In still another preferred embodiment, a cassette body contains a stack of plural recording sheets. A cassette outlet is formed in the cassette body, and passable to one of the recording sheets. A supply roller is disposed in the cassette body, for rotating to convey one of the recording sheet through the cassette outlet. A bias mechanism presses the recording sheets against the supply roller by biasing the recording sheets.

By this construction, the recording sheet package is capable of being mounted easily on the printer, because the supply roller can be caused to contact the uppermost recording sheet by use of the bias mechanism.

In another preferred embodiment, a packaging case contains a stack of plural recording sheets. A package outlet is formed in the packaging case, and passable to one of the recording sheets. An outer bag encloses the packaging case with the recording sheets with the package outlet directed substantially upwards. A suspension portion is disposed on a top edge of the outer bag, for suspension of the outer bag.

In an additional preferred embodiment, a packaging case contains a stack of plural recording sheets. A package outlet is formed in the packaging case, and passable to one of the recording sheets. An outer bag encloses the packaging case with the recording sheets with the package outlet directed substantially horizontally. A suspension portion is disposed close to a top edge of the outer bag, for suspension of the outer bag.

In another preferred embodiment, a packaging case contains a stack of plural recording sheets. A package outlet is formed in the packaging case, and passable to one of the recording sheets. An outer bag is light-tight and moistureproof, for containing the packaging case and the recording sheets. A protection bag is folded and contained in the outer bag with the packaging case, for containing the packaging case and the recording sheets after the outer bag is opened, to protect the recording sheets. A fastener is disposed to an open portion of the protection bag, for closing the protection bag in an openable manner.

By this construction, the recording sheets can be protected in the course of transportation and preservation, because the structures and orientations of the packaging case, the outer bag and/or the protection bag are suitably determined.

In a further preferred embodiment, a packaging case contains a stack of plural recording sheets. A package outlet is formed in the packaging case, and passable to one of the recording sheets. A position setter is disposed between an inside of the packaging case and the recording sheets, for preventing the recording sheets from being loose inside the packaging case.

In another preferred embodiment, a packaging case has a substantially parallelepipedic shape, for containing a stack of plural recording sheets. A package outlet is formed in the packaging case, and passable to one of the recording sheets. An inside of the packaging case has a first width, the recording sheets have a second width, the first width is smaller than the second width, and the packaging case keeps the recording sheets curved, for preventing the recording sheets from being loose therein.

By this construction, the recording sheets can be advanced while positioned stably, because the position setter or the inside of the packaging case keeps the recording sheets positioned stably.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
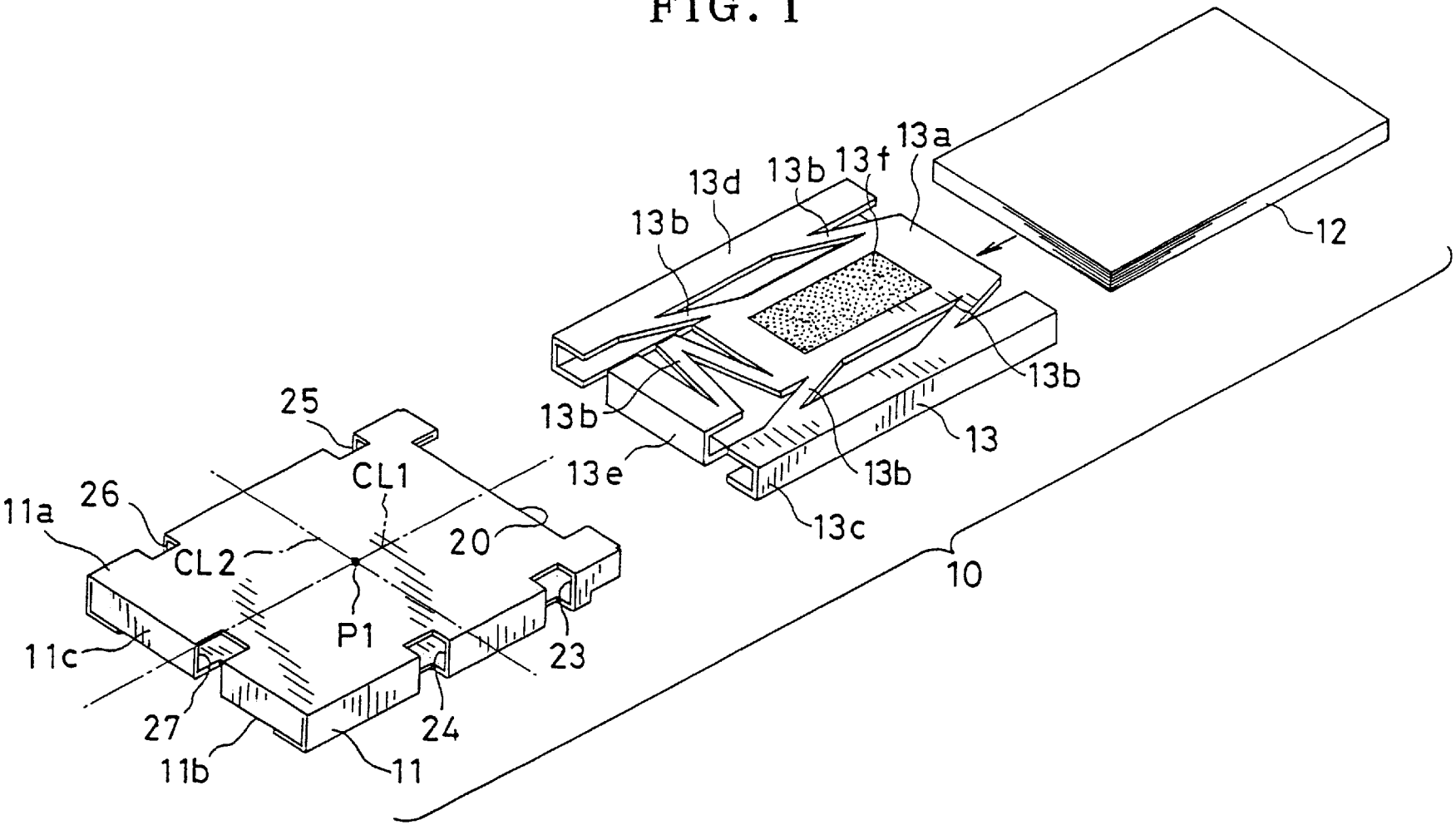
FIG. 1 is an exploded perspective illustrating a recording sheet package or cartridge of the present invention.
Figure 2:
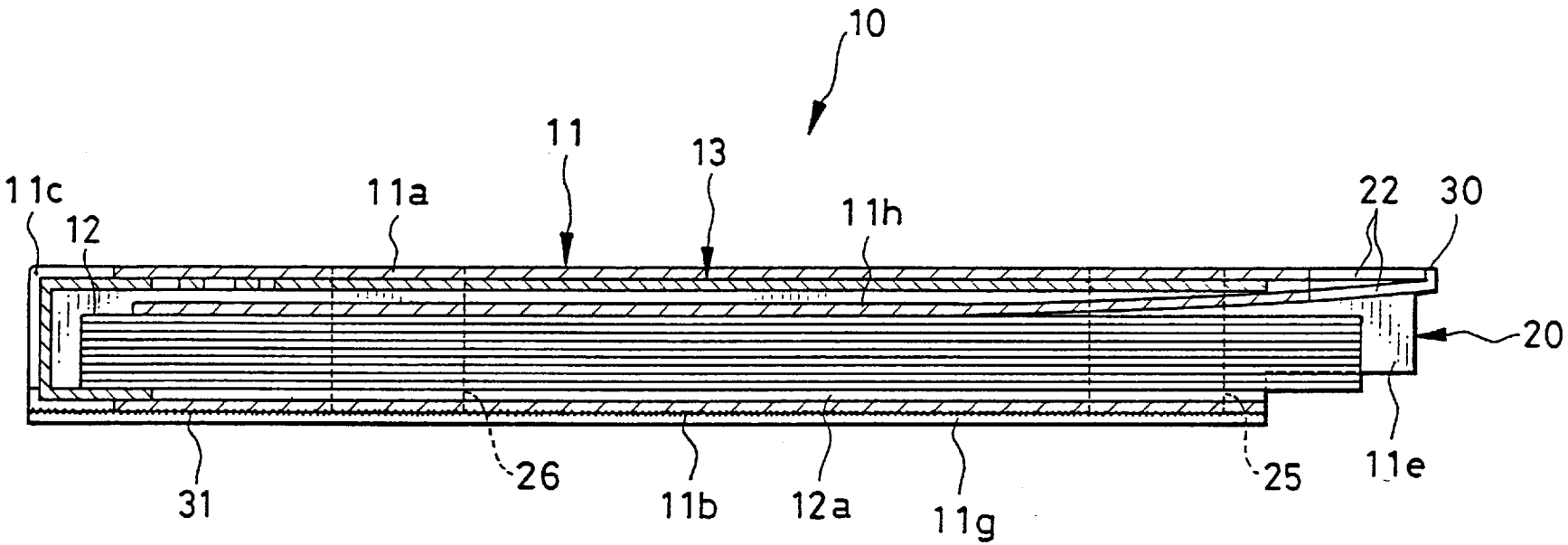
FIG. 2 is a vertical section illustrating the recording sheet package.

In FIGS. 1 and 2, a recording sheet package 10 or cartridge is constituted by a packaging case 11, thermosensitive recording sheets 12 and a blocking frame 13 positioned between the packaging case 11 and the recording sheets 12. The recording sheet package 10 is in a thin box shape, and produced from dust proof paper or cardboard with a great thickness and made of long fiber. The blocking frame 13 is also produced from dust proof paper or cardboard. The use of this type of paper is effective in avoiding creation of dust of paper in the course of cutting the paper or supply of a recording sheet. The printing is not influenced by the use of the packaging case 11 of the paper.

In FIG. 2, a stack of the 20 thermosensitive recording sheets 12 of a direct thermal printing type is contained in the packaging case 11. The recording sheets 12 are contained in the packaging case 11 by directing their recording surface downwards and their back surface upwards. If the recording sheets 12 are thermal printing stickers having an adhesive layer, the recording sheets 12 have a greater thickness so that a stack of only ten (10) recording sheets 12 is contained in the packaging case 11. Of course the number of the recording sheets 12 to be contained can be changed suitably in consideration of the thickness of the recording sheets 12. A protective sheet 12*a* is additionally disposed under the lowest one of the recording sheets 12. The protective sheet 12*a* tightly contacts the recording surface of the lowest one of the recording sheets 12, and shields the recording surface from moisture and ambient light. Note that it is possible to omit the protective sheet 12*a*.

Figure 3:
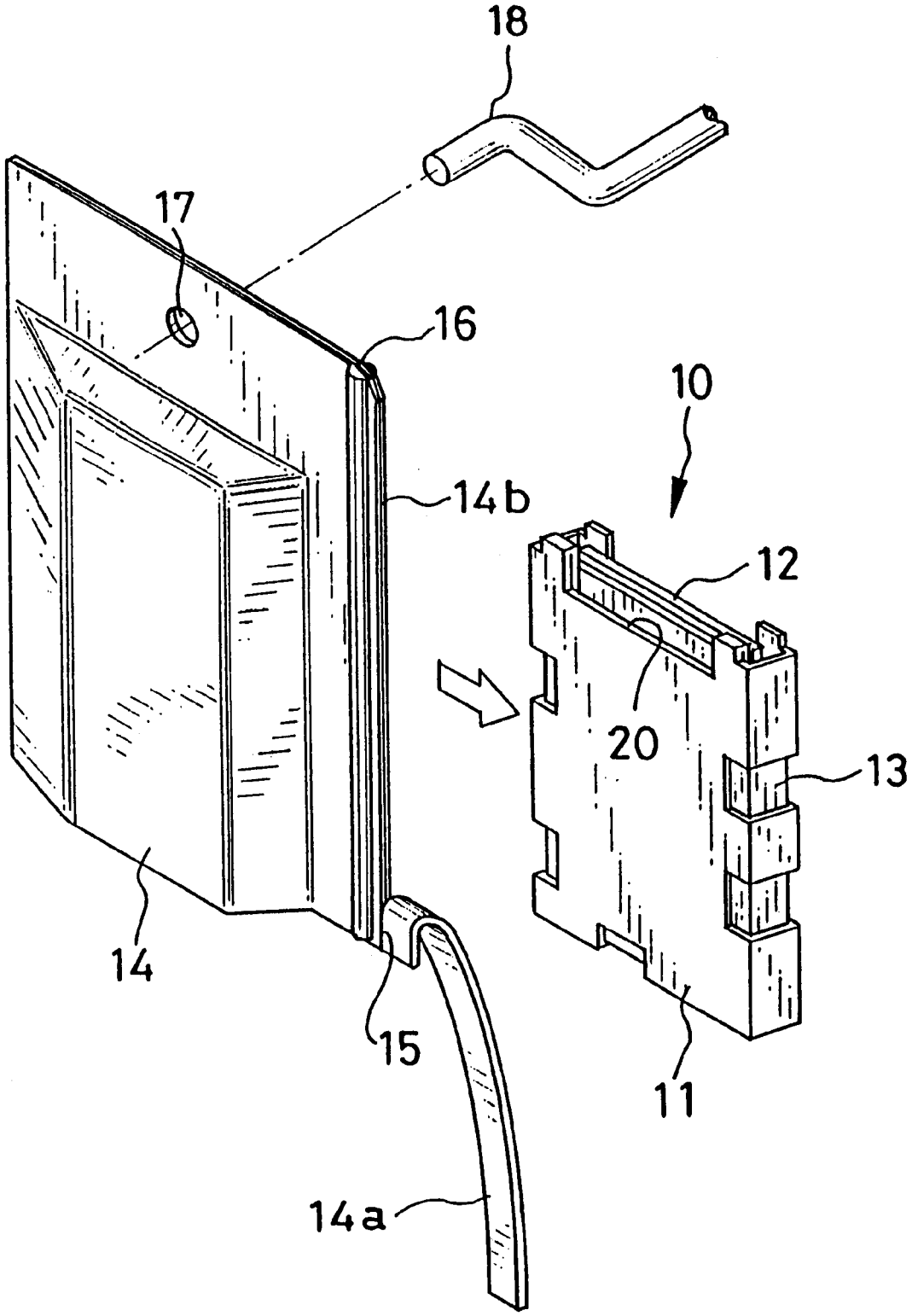
FIG. 3 is an exploded perspective illustrating the recording sheet package.

In FIG. 3, an outer bag 14 is used to contain the recording sheet package 10 for retail sale, and has lightshielding and moisture-proof characteristics. To use the recording sheet package 10, a vertical edge portion 14*a* of the outer bag 14 is torn away along a cutting line 15 to cut open the outer bag 14. A fastener 16 of synthetic resin is disposed in the vicinity of a cut edge 14*b* of the outer bag 14. The outer bag 14 is used again by opening and closing the fastener 16 for the purpose of preserving the recording sheet package 10 which is partially used. The fastener 16 is well-known in the art, and consists of a combination of a groove-formed ridge and a ridge fitted therein for tightly enclosing the inside of the outer bag 14. A suspension hole 17 is formed in the top end of the outer bag 14, and receives insertion of a suspension hook 18 for commercial display of products, so that the outer bag 14 is suspended on the suspension hook 18 for sale in a store.

Figure 4:
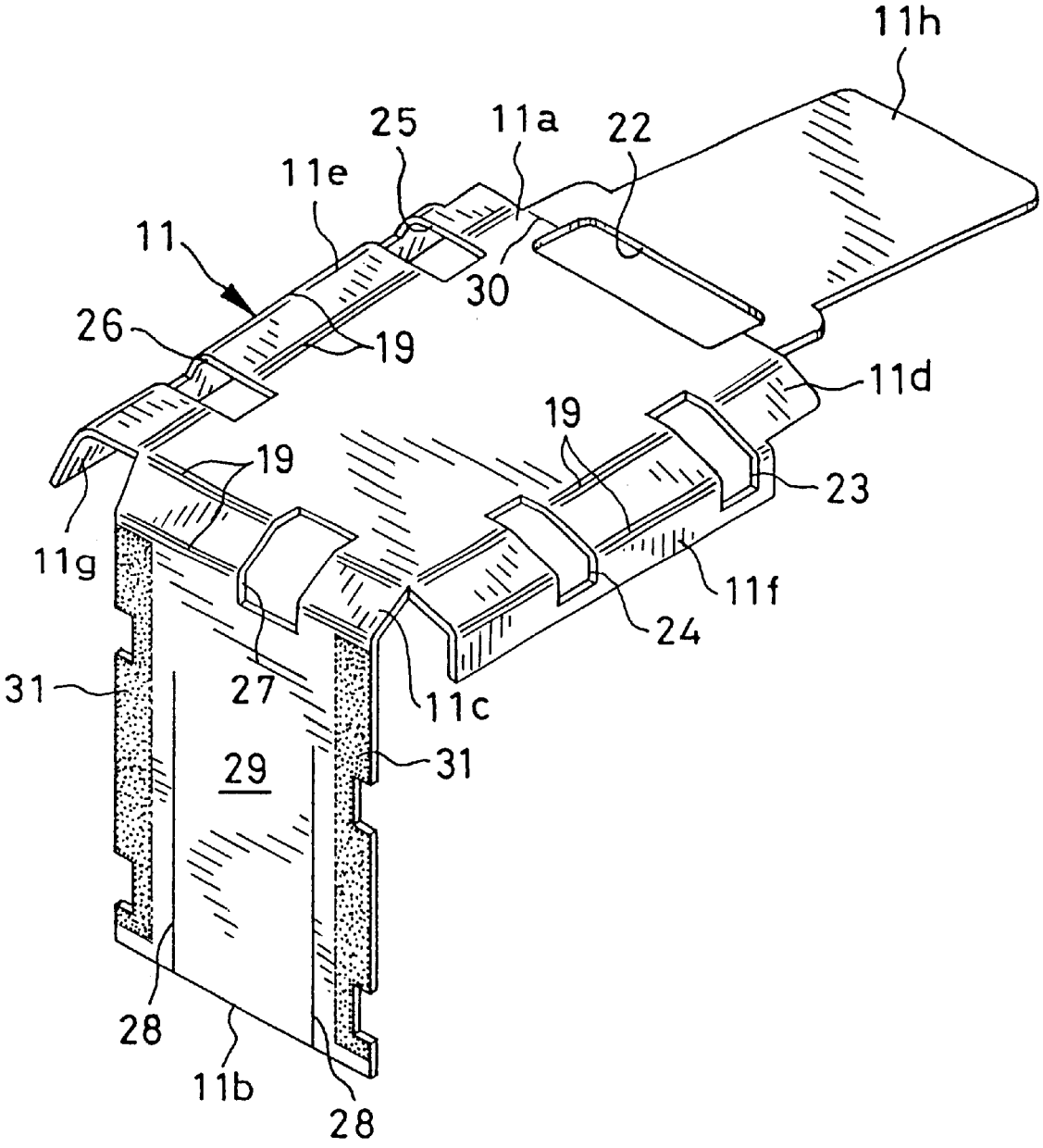
FIG. 4 is a perspective illustrating a spread state of a packaging case.

In FIG. 4, the packaging case 11 is constituted of one top plate 11*a*, one bottom plate 11*b*, one end plate 11*c* and two lateral plates 11*d* and 11*e*. The top. and bottom plates 11*a* and 11*b* are rectangular and slightly larger than the recording sheets 12. The combination of the plates 11*a*—11*e* is bent by use of bend lines 19 in an erect manner to constitute the packaging case 11 in the thin box shape.

In FIG. 1, a package outlet 20 is formed in the packaging case 11 to lie in a shorter side line of the packaging case 11. A roller receiving slot 22 is formed in the packaging case 11 along an edge between the top plate 11*a* and a push plate 11*h* (See FIG. 4), communicates with the package outlet 20, and receives a supply roller 21 (See FIG. 9) of the thermal printer. The roller receiving slot 22 is defined by forming an opening in a spread sheet from which the packaging case 11 has been produced.

Cutouts 23–27 are formed in the lateral plates 11*d* and 11*e* and the end plate 11*c*. The cutouts 23–27 are defined by partially cutting the top and bottom plates 11*a* and 11*b* in addition to cutting of the lateral plates 11*d* and 11*e* and the end plate 11*c*.

Among the cutouts 23–27 in FIG. 1, the cutouts 24, 26 and 27 are formed in positions asymmetric with respect to a reference line CL1, which is directed in a supply direction of the recording sheets 12 and passes the center P of the packaging case 11. The cutouts 23 and 25 are positioned symmetrically with respect to the reference line CL1. The cutouts 23 and 24 are formed in positions asymmetric with respect to a reference line CL2, which is perpendicular to the supply direction of the recording sheets 12 and passes the center P of the packaging case 11. The cutouts 25 and 26 are positioned symmetrically with respect to the reference line CL2.

In FIG. 4, a spread state of the packaging case 11 is illustrated. The lateral plates 11*d* and 11*e* are arranged connectively with the top plate 11*a* via the bend lines 19. Securing plates 11*f* and 11*g* are arranged connectively with the lateral plates 11*d* and 11*e* via the bend lines 19. The end plate 11*c* communicates with a shorter side line of the top plate 11*a* opposite to the package outlet 20. Also the end plate 11*c* communicates with the bottom plate 11*b*. The push plate 11*h* communicates with a shorter side line of the top plate 11*a* at the package outlet 20 via a bend line 30.

In FIG. 2, the push plate 11*h* is bent at an angle of approximately 180 degrees via the bend line 30 to lie under the top plate 11*a*. In FIG. 4, an adhesive layer 31 is formed by applying adhesive agent to regions of the securing plates 11*f* and 11*g* in contact with the bottom plate 11*b* in the vicinity of the end opposite to the package outlet 20. The adhesive layer 31 keeps the packaging case 11 shaped like a box.

A pair of slits 28 are formed in the bottom plate 11*b* to extend in the sheet supply direction. A movable portion 29 is defined between the slits 28. As will be described with FIG. 9, the movable portion 29 is pushed up by a lifter plate 57 according to a decrease of the recording sheets 12 remaining in the packaging case 11.

In FIG. 1, the packaging case 11 accommodates the 20 recording sheets 12 in contact with the blocking frame 13. The periphery of the recording sheets 12 is covered by the blocking frame 13, which is constituted by an attaching plate 13*a*, deformable portions 13*b*, and blocking portions 13*c*, 13*d* and 13*e* or position setter portions. The attaching plate 13*a* has an adhesive layer 13*f*, which attaches the attaching plate 13*a* to the bottom face of the top plate 11*a* of the packaging case 11.

The blocking portions 13*c*–13*e* have a channel shape as viewed in cross section, and are arranged to cover three side lines of the stack of the recording sheets 12, but not to cover one side line positioned in the package outlet 20. The blocking portions 13*c* and 13*d* cover the lateral sides of the recording sheets 12. The blocking portion 13*e* covers the end side of the recording sheets 12. As the blocking portions 13*c*–13*e* close the cutouts 23–27 of the packaging case 11, entry of light and moisture into the packaging case 11 is avoided, to keep the packaging case 11 shielded from light and moisture.

The deformable portions 13*b* are constituted by plates of a small width, and disposed between the attaching plate 13*a* and the blocking portions 13*c*–13 *e* to extend obliquely or in a zigzag. The blocking portions 13*c*–13 *e* have a characteristic of springs. As will be described later, guiding projections 50, 51, 52, 53 and 54 enter the cutouts 23–27 when the recording sheet package 10 is loaded in a sheet supply cassette 40, and push the blocking portions 13*c*–13 *e* toward the inside by deforming the deformable portions 13*b*. Then the recording sheets 12 are appropriately set in the supply position.

Thus the blocking frame 13 avoids entry of light and moisture through the cutouts 23–27. The light-shielded and moisture-shielded state of the packaging case 11 is not degraded even with the cutouts 23–27 formed in the packaging case 11. As illustrated in FIG. 2, the push plate 11*h* biases the recording sheets 12 toward the bottom plate 11*b* in the state contained in the packaging case 11, so the recording sheets 12 are contacted tightly on one another. Thus there is little external moisture coming to the recording surface of the recording sheets 12, which can be shielded from moisture with further effectiveness.

Figure 6:
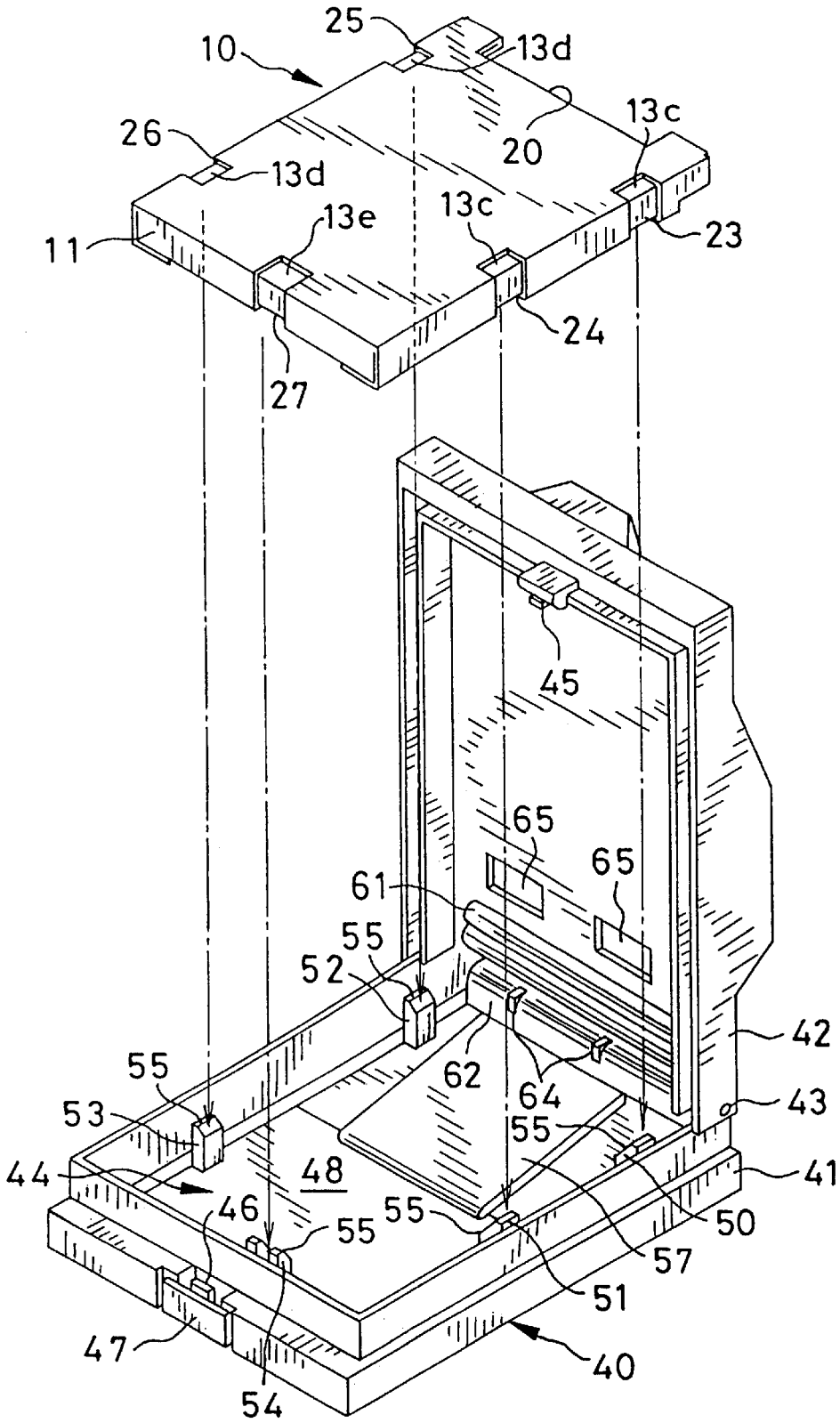
FIG. 6 is a perspective illustrating the sheet supply cassette and the recording sheet package.
Figure 7:
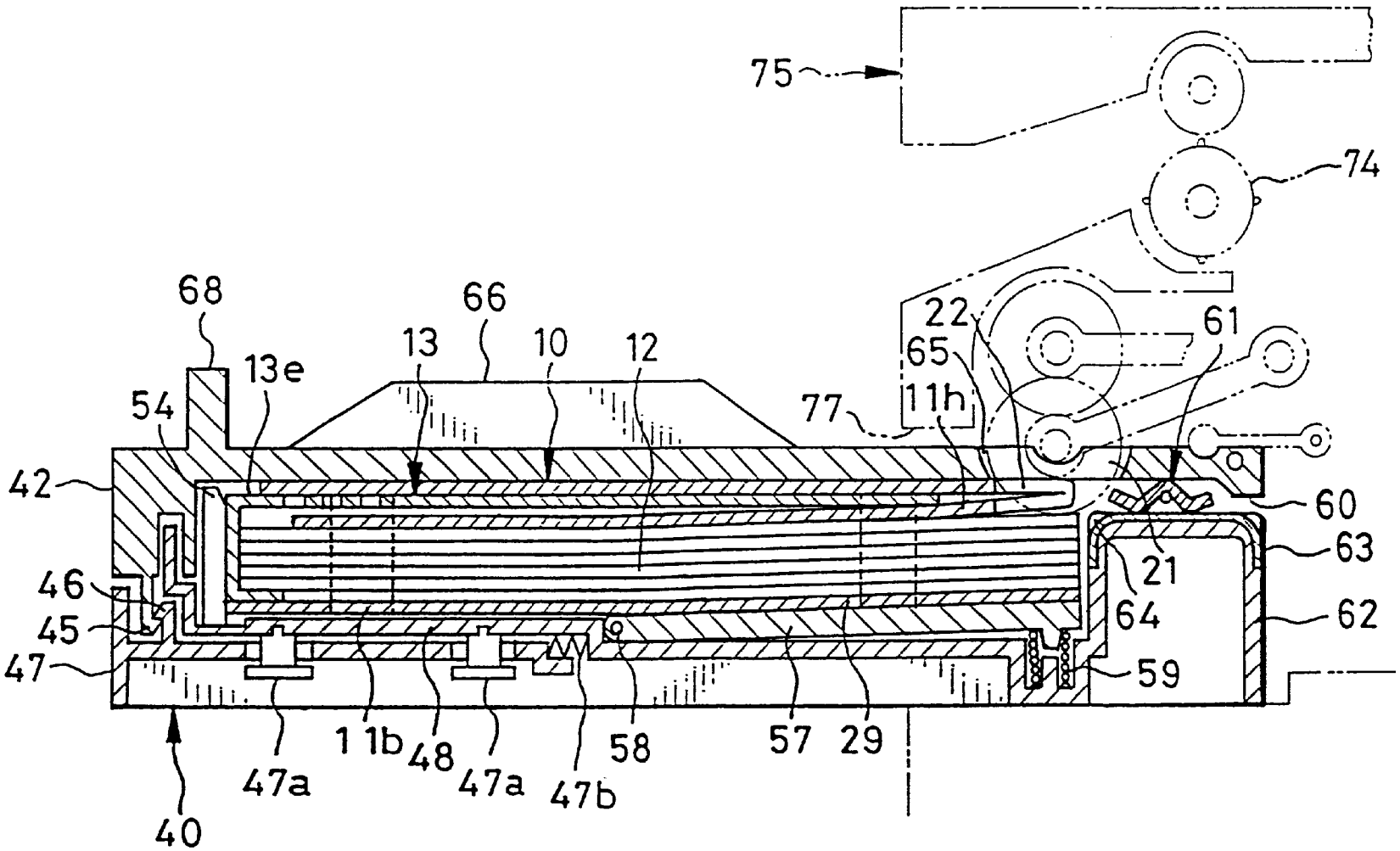
FIG. 7 is a vertical section illustrating the sheet supply cassette at an loading opening of a thermal printer.

In FIGS. 6 and 7, a sheet supply cassette 40 to contain the recording sheet package 10 is illustrated. A cassette body of the sheet supply cassette 40 is constituted by a cassette portion 41 and a lid 42, and generally has a box shape.

The lid 42 is supported on the cassette portion 41 in a rotatable manner about an axis defined by a pivot 43, and is openable within an angle range of approximately 90 degrees. In FIG. 6, a package chamber 44 of the cassette portion 41 is loaded with the recording sheet package 10 while the lid 42 is kept open erectly. When the lid 42 is closed, retainer claws 45 and 46 in FIG. 7 are engaged with each other to keep the lid 42 closed. To open the lid 42, an unlocking plate 47 is pushed to disengage the retainer claw 45 from the retainer claw 46, so that the lid 42 is rendered openable. The unlocking plate 47 is kept slidable in the supply direction by slide supporting shafts 47*a* on a base plate 48. The unlocking plate 47 is biased by a coil spring 47*b* in a direction of engaging the retainer claws 45 and 46.

In FIG. 6, the package chamber 44 has a slightly greater area than the recording sheet package 10 so as to facilitate the loading operation. Guiding projections 50–54 are arranged on the base plate 48 of the package chamber 44 in positions of the cutouts 23–27. The guiding projections 5054 respectively have a rectangular shape, and are provided with a guide face 55 on the top. The guide face 55 is inclined, and causes the guiding projections 50–54 smoothly to enter the cutouts 23–27.

When the recording sheet package 10 is set in the package chamber 44 in the correct position, the guiding projections 50–54 enter the cutouts 23–27 to allow loading the recording sheet package 10 in the package chamber 44. If the recording sheet package 10 is set in the package chamber 44 with a left lateral side of the recording sheet package 10 oriented to the right, or with its front edge oriented to the rear, then the guiding projections 50–54 are not positioned at the cutouts 23–27. The recording sheet package 10 cannot be inserted and can be found to be incorrectly set. A user is enabled to reinsert the recording sheet package 10 in the package chamber 44 by correcting the orientation of the recording sheet package 10.

Figure 8:
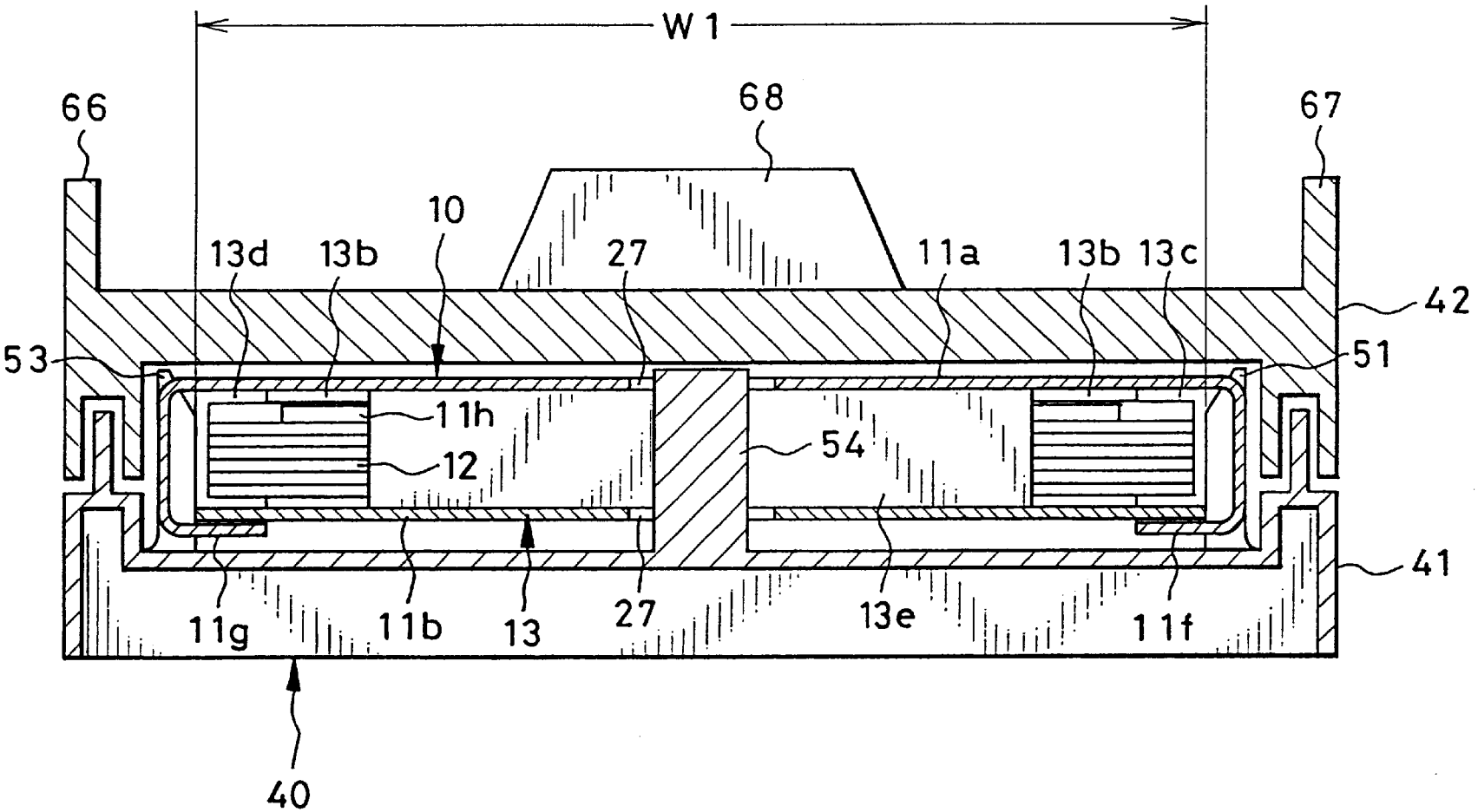
FIG. 8 is a cross section illustrating the sheet supply cassette containing the recording sheet package.

The guiding projections 50–53 are laterally disposed as two pairs. In FIG. 8, let W1 be a distance from the level of the guiding projections 50 and 51 to the level of the guiding projections 52 and 53. The distance W1 is determined slightly greater than the width of the recording sheets. Thus the lateral sides of the recording sheets 12 are neatly set in contact with the blocking portions 13*c* and 13*d* by entry of the guiding projections 50–53 into the packaging case 11 through the cutouts 23–26. Also the recording sheets 12 are positioned in the direction crosswise to the supply direction of the recording sheets 12, no matter how loosely the packaging case 11 has initially been containing the recording sheets 12. The recording sheets 12 are prevented from being jammed or provided with an obliquely printed image, as the recording sheets 12 do not move obliquely.

In FIG. 7, the rear edges of the recording sheets 12 are arranged neatly in contact with the blocking portion 13*e* by the guiding projection 54 which is located opposite to a cassette outlet 60. The guiding projection 54 also tightly positions the recording sheets 12 in the supply direction. If the recording sheets 12 are loosely contained in the packaging case 11, setting of the recording sheet package 10 in the sheet supply cassette 40 automatically tightens the recording sheets 12 in the supply direction.

The lifter plate 57 is disposed in the package chamber 44, and is supported on the base plate 48 rotatably about an axis defined by a pivot 58. The lifter plate 57 is biased upwards by a coil spring 59 as bias mechanism, to push up the movable portion 29 of the packaging case 11.

A gap is formed between the cassette portion 41 and the lid 42 in the vicinity of the pivot 43 while the lid 42 is closed.

This gap constitutes the cassette outlet 60. A light-shielding plate 61 is disposed in a path near to the cassette outlet 60 on the side of the lid 42. The light-shielding plate 61 is a spring plate which biases the recording sheets 12 toward a wall of the path on the side of the cassette portion 41.

A sheet separator 62 is disposed to project in a supply path near to the cassette outlet 60 on the side of the cassette portion 41. A cork member 63 is attached to the surface of the sheet separator 62. When two of the recording sheets 12 remain overlapped on one another while supplied, the cork member 63 frictionally stops the lower one of the two of the recording sheets 12 from advancing. Thus only the uppermost one of the recording sheets 12 is allowed to advance each time. Furthermore, the sheet separator 62 has two separator projections 64 for avoiding double supply of the recording sheets 12. The separator projections 64 contact the lower one of the two of the recording sheets 12, to stop it from advancing.

Figure 9:
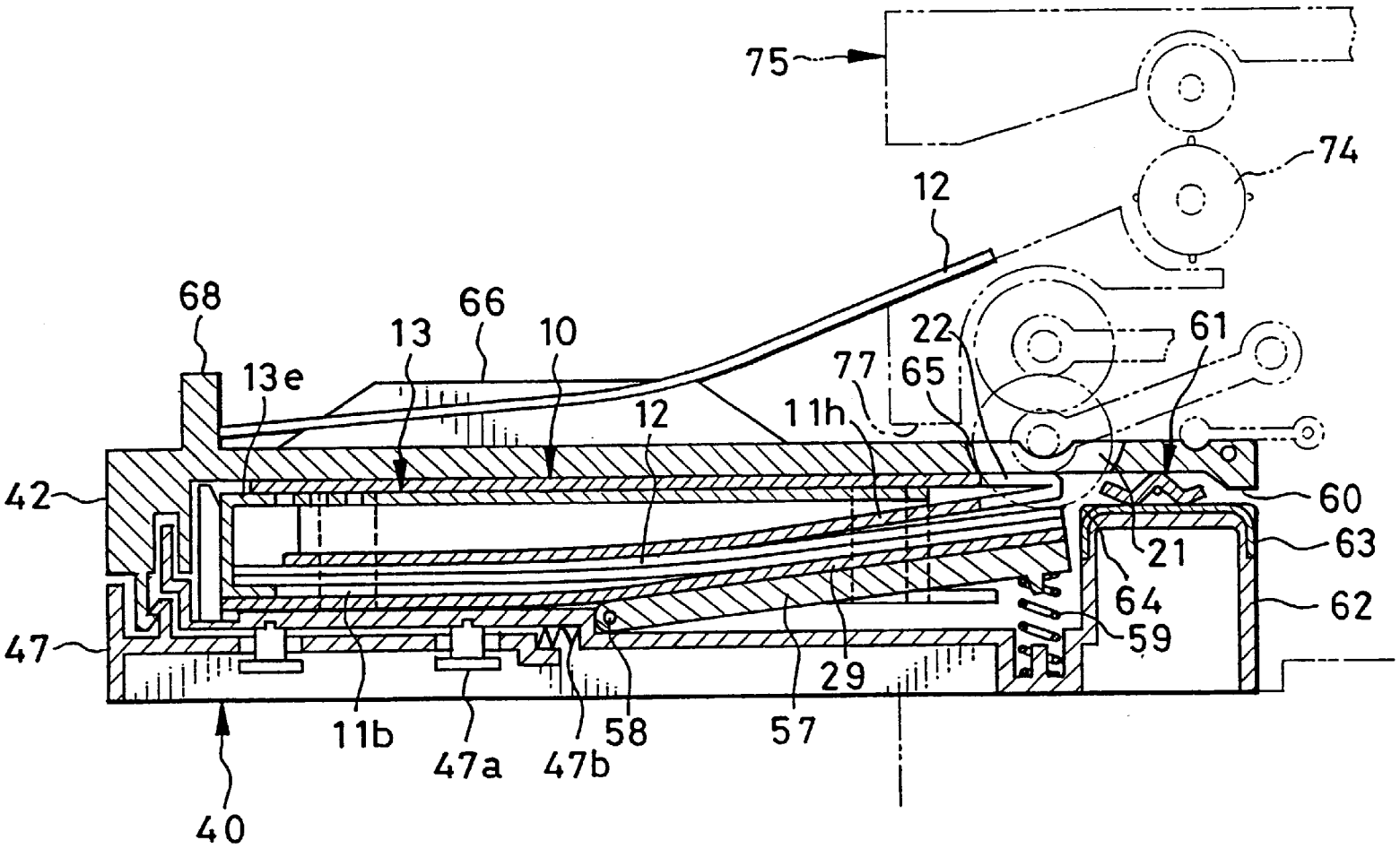
FIG. 9 is a vertical section illustrating the same as FIG. 7 but in which the remaining sheets are decreasing.

In FIG. 9, insertion openings 65 are formed in the lid 42 in positions corresponding to the roller receiving slot 22 in the recording sheet package 10. In a thermal printer 75, the sheet supply cassette 40 is set, so as to cause portions of the supply roller 21 to enter the insertion openings 65. The supply roller 21 contacts the uppermost one of the recording sheets 12 in the recording sheet package 10. The supply roller 21 rotates in the supply direction in the course of printing. Thus only the uppermost one of the recording sheets 12 is advanced from the recording sheet package 10 toward a printing stage in the thermal printer 75.

Figure 5:
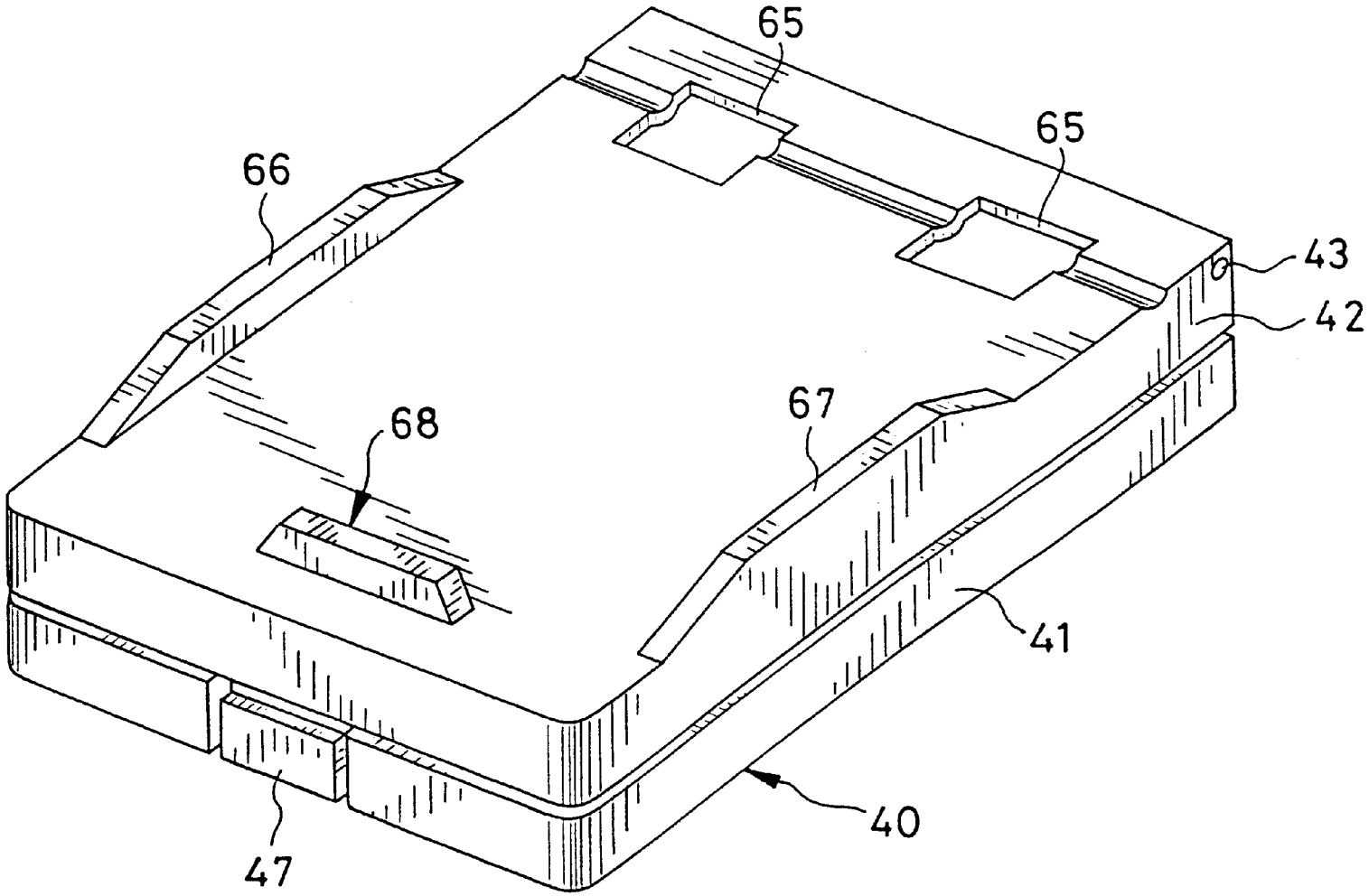
FIG. 5 is a perspective illustrating a sheet supply cassette.

In FIGS. 5 and 9, a top face of the lid 42 consists of an ejection tray. Sheet guide walls 66 and 67 and a stopper wall 68 are disposed on the lid 42. The sheet guide walls 66 and 67 regulate lateral sides of an ejected one of the recording sheets 12, and lie along the longer side lines of the lid 42. The stopper wall 68 prevents the ejected one of the recording sheets 12 from dropping away from the lid 42 by contacting an advancing edge of the recording sheets 12.

Figure 10:
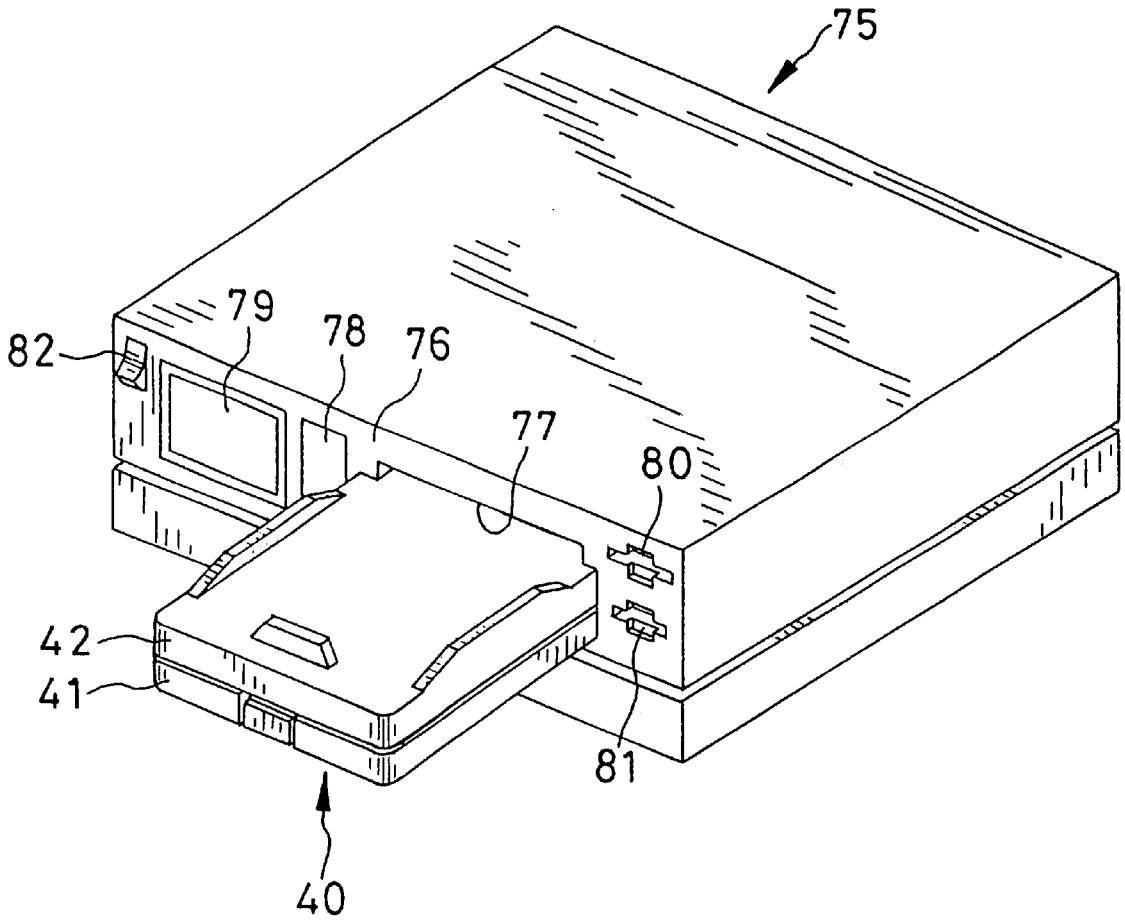
FIG. 10 is a perspective illustrating the thermal printer.

In FIG. 10, the thermal printer 75 with the sheet supply cassette 40 is illustrated. A front face 76 of the thermal printer 75 has a loading opening 77, into which the sheet supply cassette 40 is inserted. In FIG. 9, portions of the supply roller 21 in the loading opening 77 enter the insertion openings 65 in the lid 42 when the sheet supply cassette 40 is set in the loading opening 77. As the recording sheets 12 in the sheet supply cassette 40 are kept pushed up by the lifter plate 57, the uppermost one of the recording sheets 12 contacts the supply roller 21.

The front face 76 has the loading opening 77 with an operation panel 78, a liquid crystal display (LCD) panel 79, an IC card insertion port 80, a smart media insertion port 81 and a power switch 82. When the operation panel 78 is operated to enter printing instructions, an image to be printed is displayed in the LCD panel 79. After checking the displayed image, a printing key in the operation panel 78 is operated to start printing.

For the printing, the supply roller 21 is rotated in the supply direction at first. The uppermost one of the recording sheets 12 is advanced and supplied into the thermal printer 75. A thermal head is driven to print an image to the one of the recording sheets 12 in the three-color frame-sequential recording. The image is recorded one line after another. The thermal head is driven for each pixel to be recorded in synchronism with the conveyance of the one of the recording sheets 12. Also an ultraviolet lamp is driven upon the thermal recording for the color having been recorded. Thus the image of this color is fixed, not to develop color further in the following steps of the recording. After the three-color frame-sequential recording, the one of the recording sheets 12 in FIG. 9 is ejected by ejector rollers 74 to the lid 42 of the sheet supply cassette 40, to finish the printing operation.

To load the sheet supply cassette 40 with the recording sheet package 10, at first the sheet supply cassette 40 is removed from the loading opening 77 in the thermal printer 75. In FIG. 6, the lid 42 is opened. If the packaging case 11 emptied after the previous use remains in the sheet supply cassette 40, the packaging case 11 is removed before the recording sheet package 10 is inserted. The cutouts 23–27 in the packaging case 11 are positioned at each of the guiding projections 50–54 of the package chamber 44. Therefore, the recording sheet package 10 is correctly set in the package chamber 44.

If the recording sheet package 10 is erroneously oriented to be set in the package chamber 44, for example if a left lateral side of the recording sheet package 10 is oriented to the right, or its front edge is oriented to the rear, then at least one of the guiding projections 50–54 is not received in the cutouts 23–27 but interferes with the periphery of the recording sheet package 10. Thus the recording sheet package 10 can be set in a correct orientation in the package chamber 44. No wasteful recording operation occurs. Recording heat is prevented from being applied to the back surface of the recording sheet 12. The heating element array of the thermal head would be damaged if they should heat the back surface of the recording sheet 12. But the heating element array are protected from being damaged in accordance with the present invention.

At the time of inserting the recording sheet package 10 into the package chamber 44, the guiding projections 50–54 of the package chamber 44 enter the cutouts 23–27. The edges of the recording sheets 12 are pushed and neatened in contact with the blocking portions 13*c*–13 *e* by the inside of the guiding projections 50–54. The recording sheets 12 can be set exactly in the supply position. Even though the recording sheets 12 are loose with reference to the inside of the packaging case 11, the recording sheets 12 are regulated by the guiding projections 50–54 upon the loading of the recording sheet package 10 when set in the supply position.

In FIG. 9, only a very small number of the recording sheets 12 remain. The lifter plate 57 raises the movable portion 29 of the packaging case 11. The push plate 11*h* pushes down the uppermost one of the recording sheets 12. Thus the remaining recording sheets 12 can be kept in contact with one another while laid on one another. The recording surface of the recording sheets 12 is all directed downwards. The protective sheet 12*a* is disposed on the lowest one of the recording sheets 12. Thus the recording surface is protected from being directly subjected to air, and shielded from moisture and light without considerable failure. The bottom plate ll*b* does not have an opening. The movable portion 29 as a part of the bottom plate 11*b* is movable up according to the use of the recording sheets 12. Thus no dust enters through the bottom plate 11*b*. There is no failure in the operation of the bottom plate 11*b* to shield moisture and light. The cutouts 23–27 are blocked by the blocking portions 13*c*–13 *e*. Thus entry of light or moisture into the cutouts 23–27 is avoided. Moisture and light can be reliably shielded.

Figure 11:
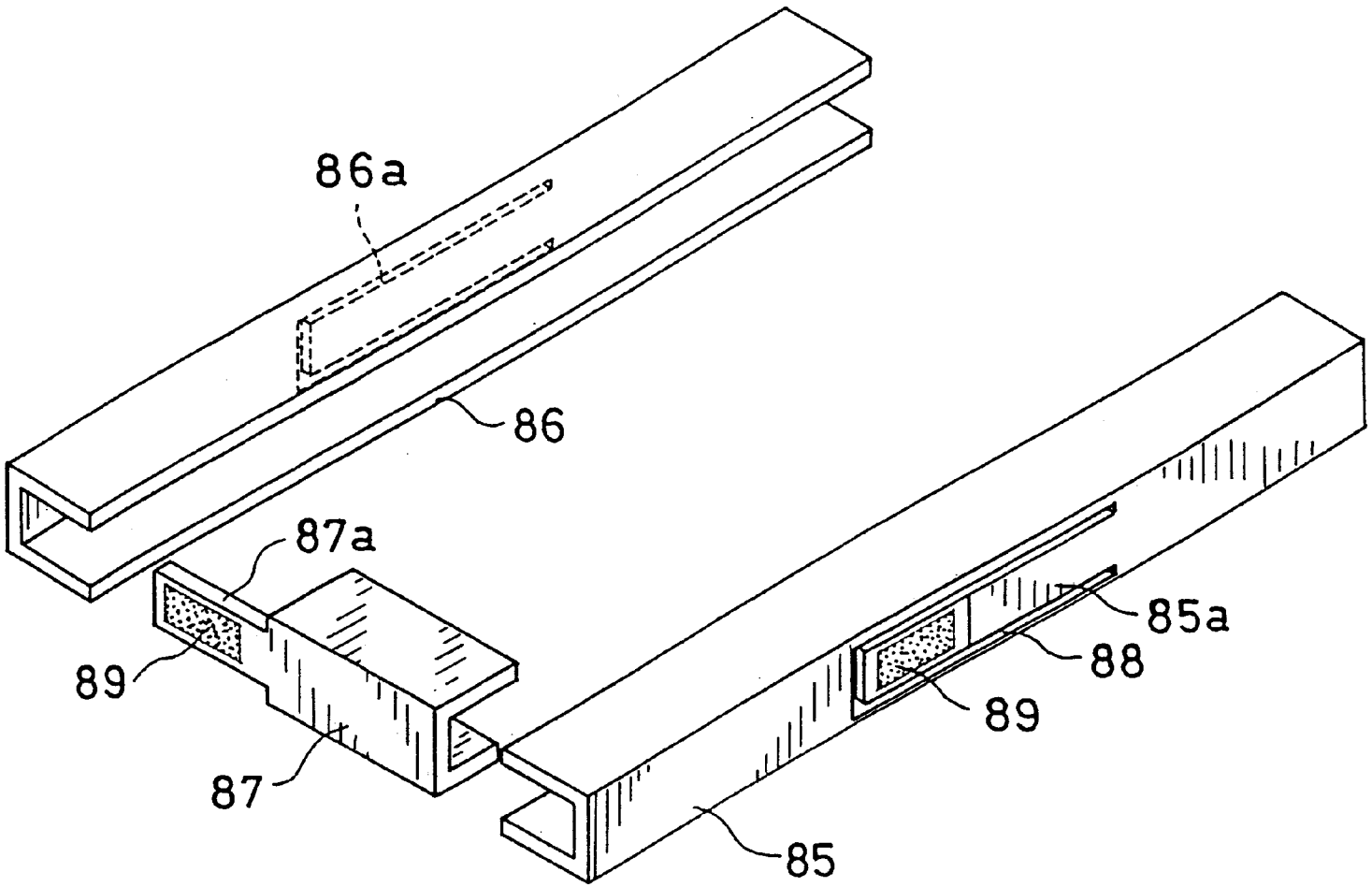
FIG. 11 is a perspective illustrating another preferred blocking mechanism including three blocking members.

If the recording sheets 12 are replaced with thermal printing stickers having the greater thickness, the recording sheet package is replaced. In FIG. 11, the sheet supply cassette 40 is removed from the thermal printer 75, and opened. The recording sheet package 10 partially used is ejected, instead of which a new recording sheet package 10 is inserted.

In FIG. 9, the push plate 11*h* pushes the recording sheets 12 toward the bottom plate 11*b* no matter how few the remaining sheets among the recording sheets 12 contained in the recording sheet package from the sheet supply cassette 40. Thus the recording sheets 12 are squeezed between the push plate 11*h* and the bottom plate 11*b* . The recording sheets 12 are reliably kept from dropping out of the packaging case 11. Note the recording sheet package 10 being removed can be preserved in the light-shielded and moisture-shielded state, as the recording sheet package 10 is recontained in the outer bag 14 of FIG. 3 and enclosed therein by closing the fastener 16.

In the above embodiment, the blocking frame 13 is constituted by the attaching plate 13*a*, the blocking portions 13*c*–13 *e*, and the deformable portions 13*b* connecting the blocking portions 13*c*–13 *e* to the attaching plate 13*a*. Alternatively, a blocking member 85 or position setter member, illustrated in FIG. 11, may include a deformable portion 85*a* defined by a channel-shaped slot 88. A blocking member 86 may include a deformable portion 86*a* defined by the channel-shaped slot 88. A blocking member 87 may have a deformable portion 87*a* as an extended end. The deformable portions 85*a*, 86*a* and 87*a* may be attached to a packaging case by an attaching portion 89 with an adhesive layer. Furthermore, the deformable portions 85*a*, 86*a* and 87*a* may be separate members, and may be attached to the packaging case and to blocking members. In the above embodiments, the blocking members and the deformable portions are produced from paper or cardboard. Alternatively, the blocking members and the deformable portions may be produced from plastic.

Figure 12:
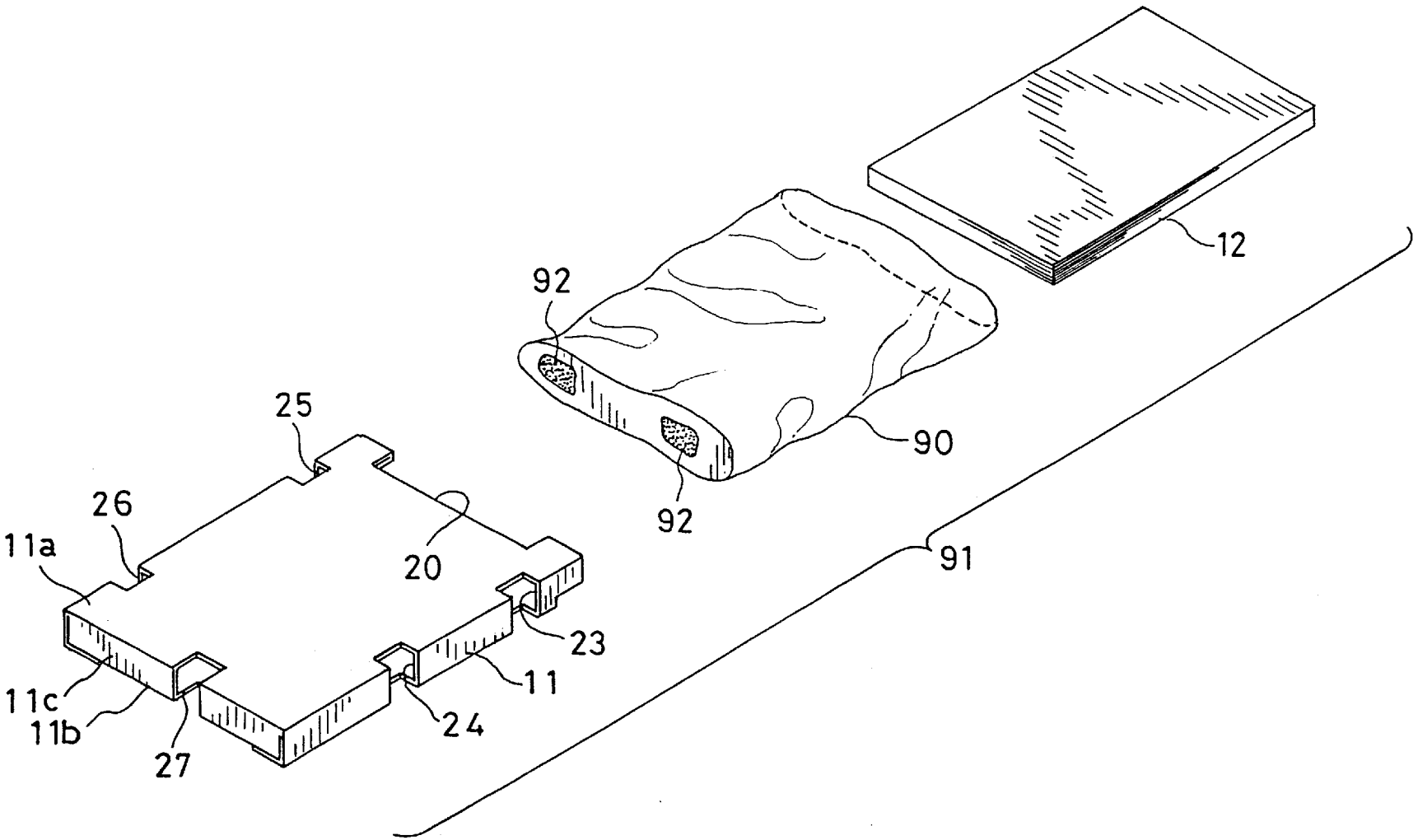
FIG. 12 is an exploded perspective illustrating another preferred recording sheet package with an auxiliary bag.

In the above embodiments, the cutouts 23–27 are blocked by the blocking portions 13*c*–13 *e* and the blocking members 85–87. Alternatively, a recording sheet package 91 or cartridge can contain an auxiliary blocking bag 90 or position setter bag as illustrated in FIG. 12. The auxiliary blocking bag 90 block the cutouts 23–27, and also contains the recording sheets 12 loosely. The auxiliary blocking bag 90 may be preferably produced from a thin soft sheet of plastic material having light-shielding and moisture-proof characteristics. There are attaching portions 92 with an adhesive layer on the auxiliary blocking bag 90, which is attached to the end plate 11*c* of the packaging case 11 by the attaching portions 92. Note that elements similar to those of the above embodiment of FIG. 1 are designated with identical reference numerals, and are not described any further. It is also possible to dispose an adhesive layer (not shown) at an open end of the auxiliary blocking bag 90 for attaching the auxiliary blocking bag 90 to the packaging case.

Figure 13:
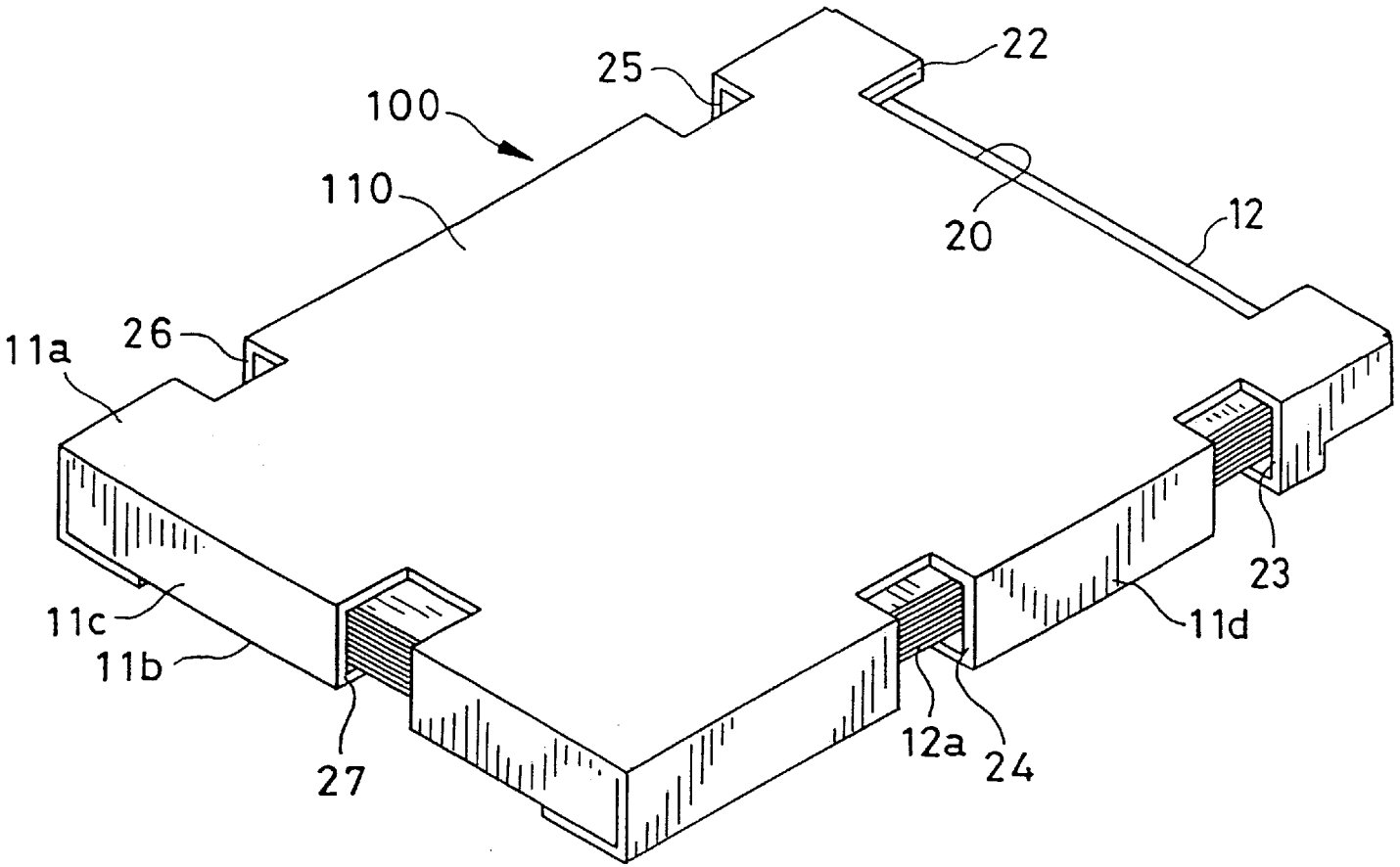
FIG. 13 is a perspective illustrating a further preferred recording sheet package without a blocking mechanism.
Figure 14:
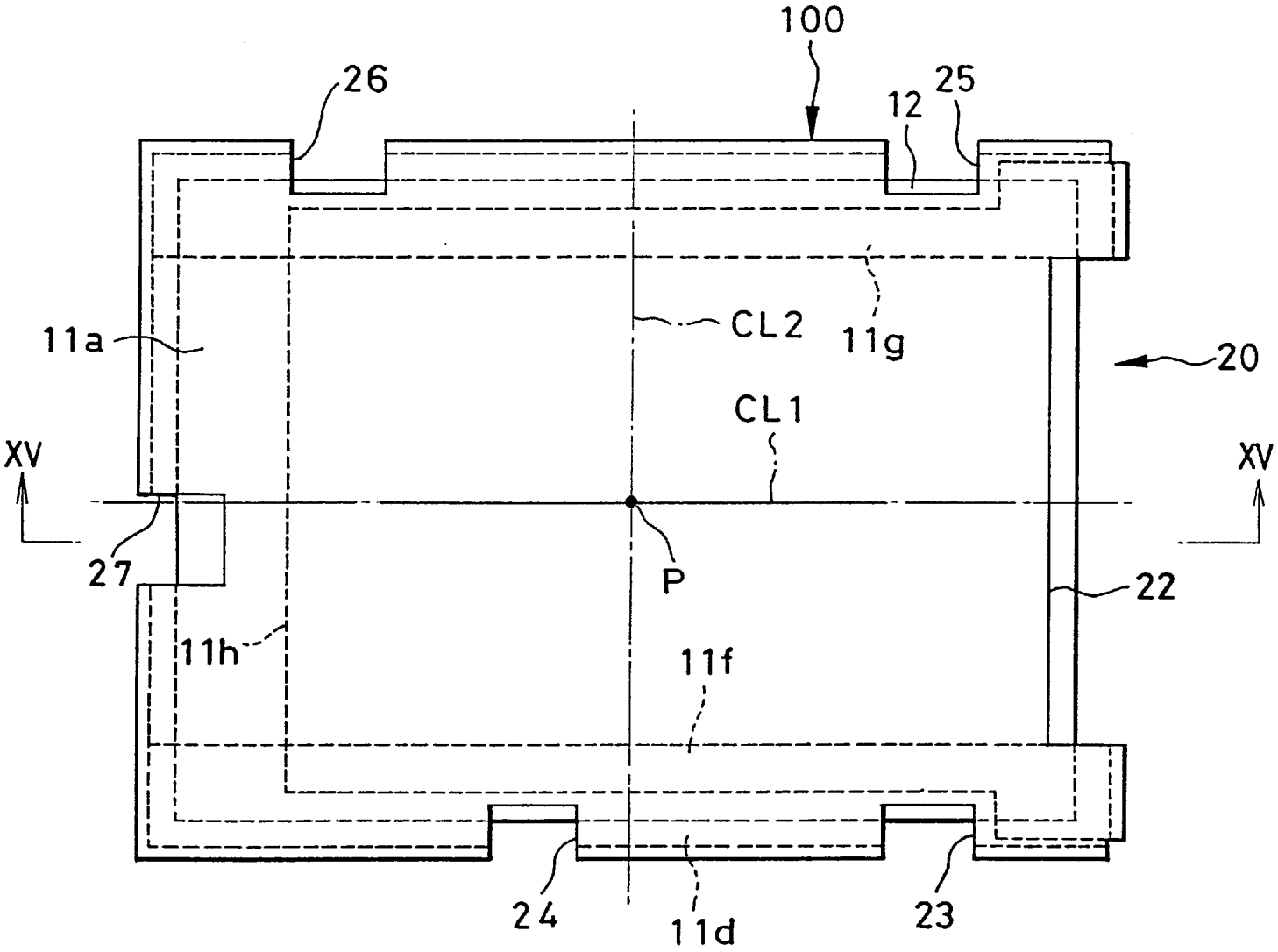
FIG. 14 is a plan illustrating the recording sheet package of FIG. 13.

In FIGS. 13–23, preferred sheet supply cassettes are described, in which recording sheets are advantageously separated from one another. In FIGS. 13 and 14, a recording sheet package 100 or cartridge includes a packaging case 110, which is in a thin box shape, and produced from dust proof paper or cardboard with a great thickness and made of long fiber.

Figure 15:
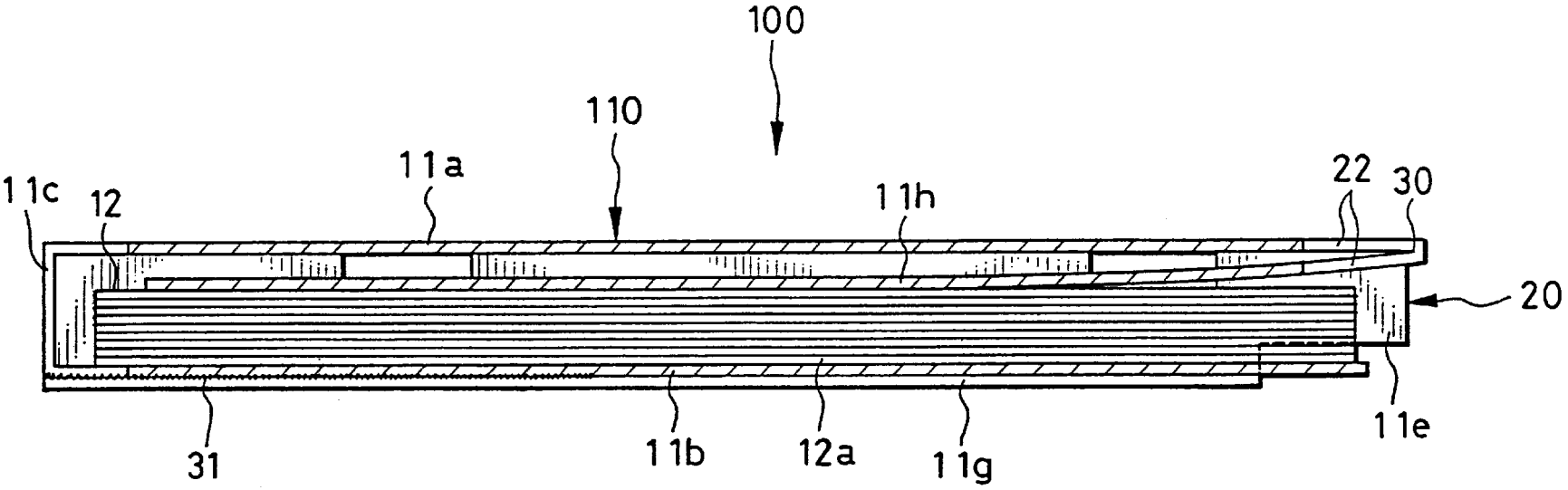
FIG. 15 is a vertical section illustrating the recording sheet package.

In FIG. 15, the packaging case 110 contains the stack of the recording sheets 12. The push plate 11*h* biases the recording sheets 12 toward the bottom plate 11*b* in the state contained in the packaging case 110, so the recording sheets 12 are contacted tightly on one another. Thus there is little external moisture coming to the recording surface of the recording sheets 12, which can be shielded from moisture with further effectiveness.

Figure 16:
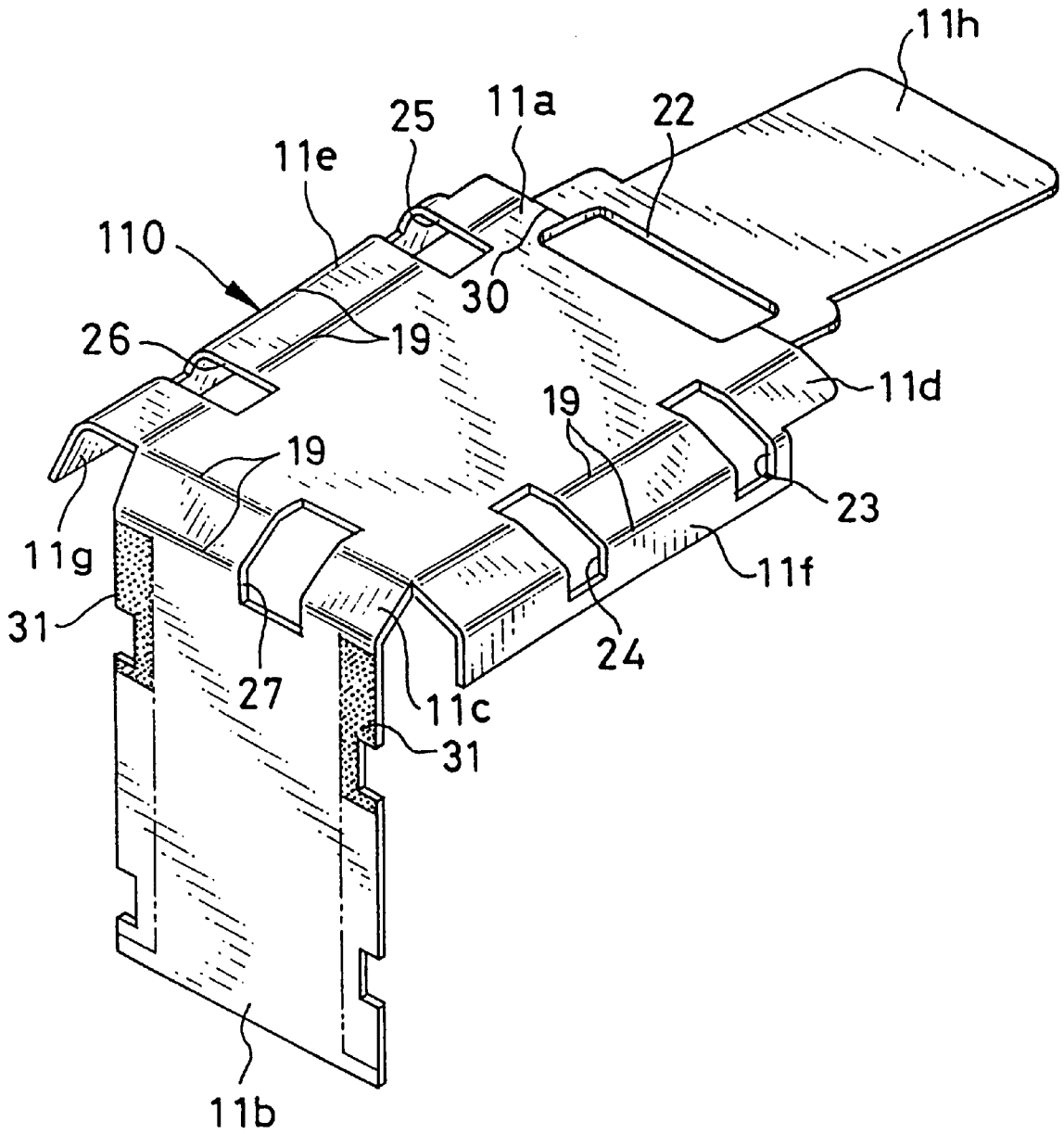
FIG. 16 is a perspective illustrating a spread state of a packaging case.

In FIGS. 15 and 16, the adhesive layer 31 keeps the packaging case 11 shaped like a box. The regions with the adhesive layer 31 are not the entire surface of the securing plates 11*f* and 11*g*. A length of those regions of the adhesive layer 31 is at least ⅓ as great as a length of the longer side line of the packaging case 11, and at most ½ as great as the same. The remainder of the securing plates 11*f* and 11*g* is not attached but free from the remaining portion of the bottom plate 11*b*, which operates like a movable flap.

Figure 18:
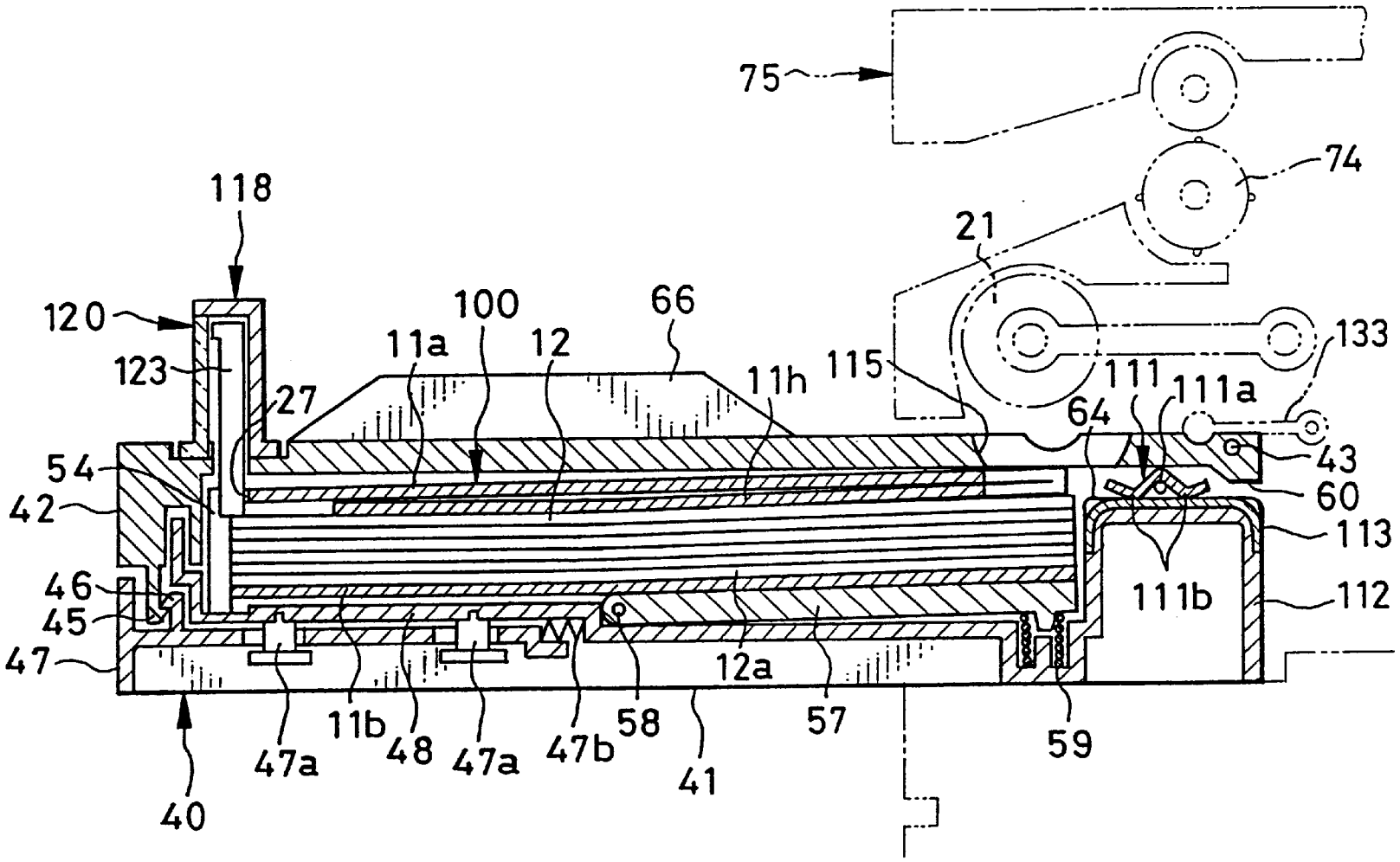
FIG. 18 is a vertical section illustrating the sheet supply cassette at the loading opening of the thermal printer.

In FIG. 18, the cassette outlet 60 is formed between the cassette portion 41 and the lid 42 in the vicinity of the pivot 43 while the lid 42 is closed. A light-shielding plate 111 is secured to the lid 42 by a securing rod 111*a*. The light-shielding plate 111 is a spring plate, which is defined by bending a resilient plate in a corrugated manner, and includes bend portions 111*b*. The bend portions 111*b* bias the recording sheets 12 toward the wall of the path on the side of the cassette portion 41.

The bend portions 111*b* are extended in forward and backward directions from the securing rod 111*a* along the supply path. The bend portions 111*b* contact the wall on the side of the cassette portion, and close the cassette outlet 60 in a tight manner. Thus entry of dust is avoided. Entry of light and moisture is avoided in a more reliable manner.

As the two bend portions 111*b* are ready to operate for the closing, at least one of the bend portions 111*b* closes the path if each of the two ends of the recording sheet passes the light-shielding plate 111 and flexes the bend portions 111*b*.

A sheet separator 112 is disposed to project over the cassette portion 41 near to the cassette outlet 60. A cork member 113 is attached to the surface of the sheet separator 112. The cork member 113 covers substantially the entirety of the top of the sheet separator 112. However the cork member 113 may be attached only to the center of the sheet separator 112 to be contacted by the recording sheet 12.

Figure 17:
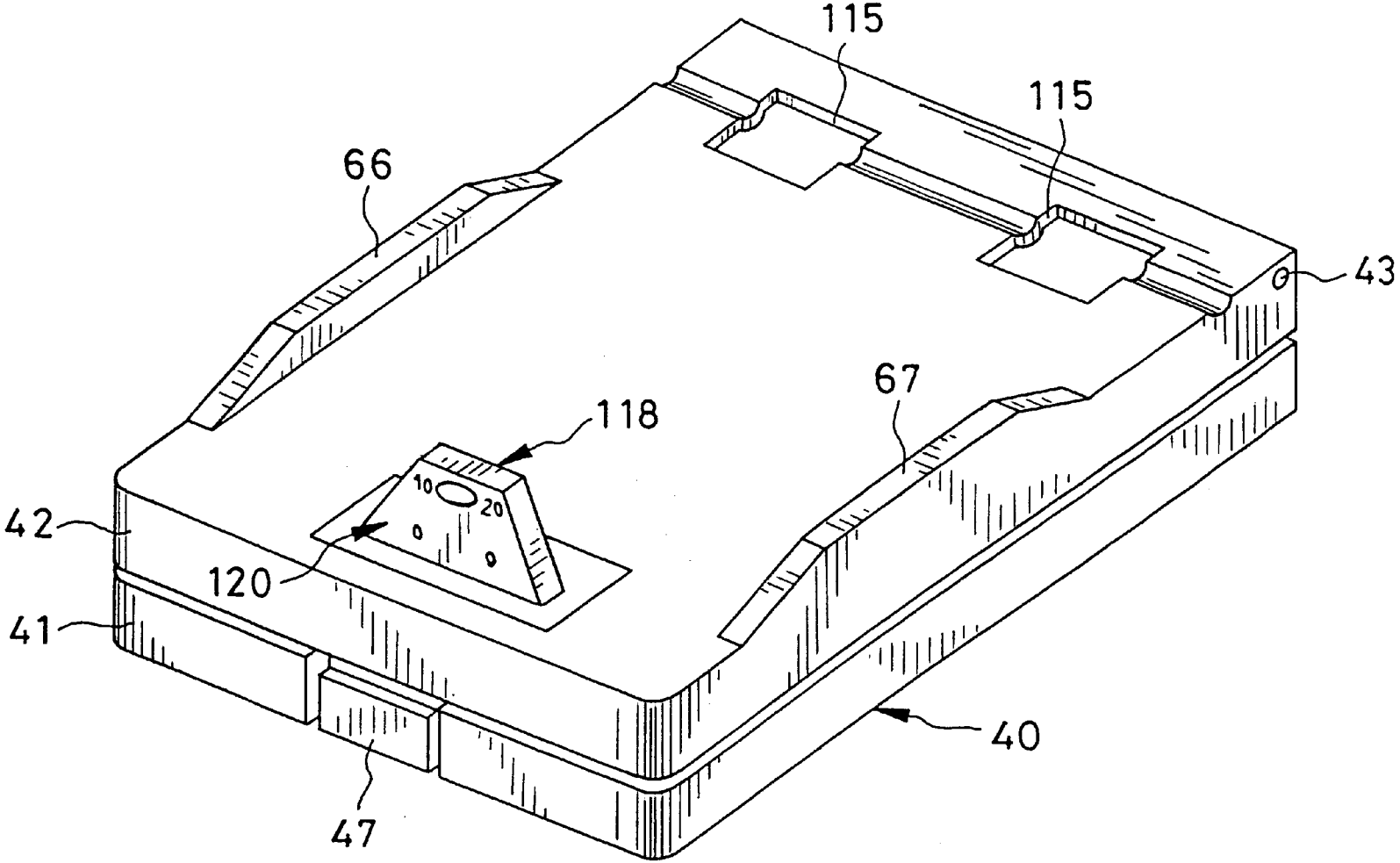
FIG. 17 is a perspective illustrating another preferred sheet supply cassette.
Figure 19:
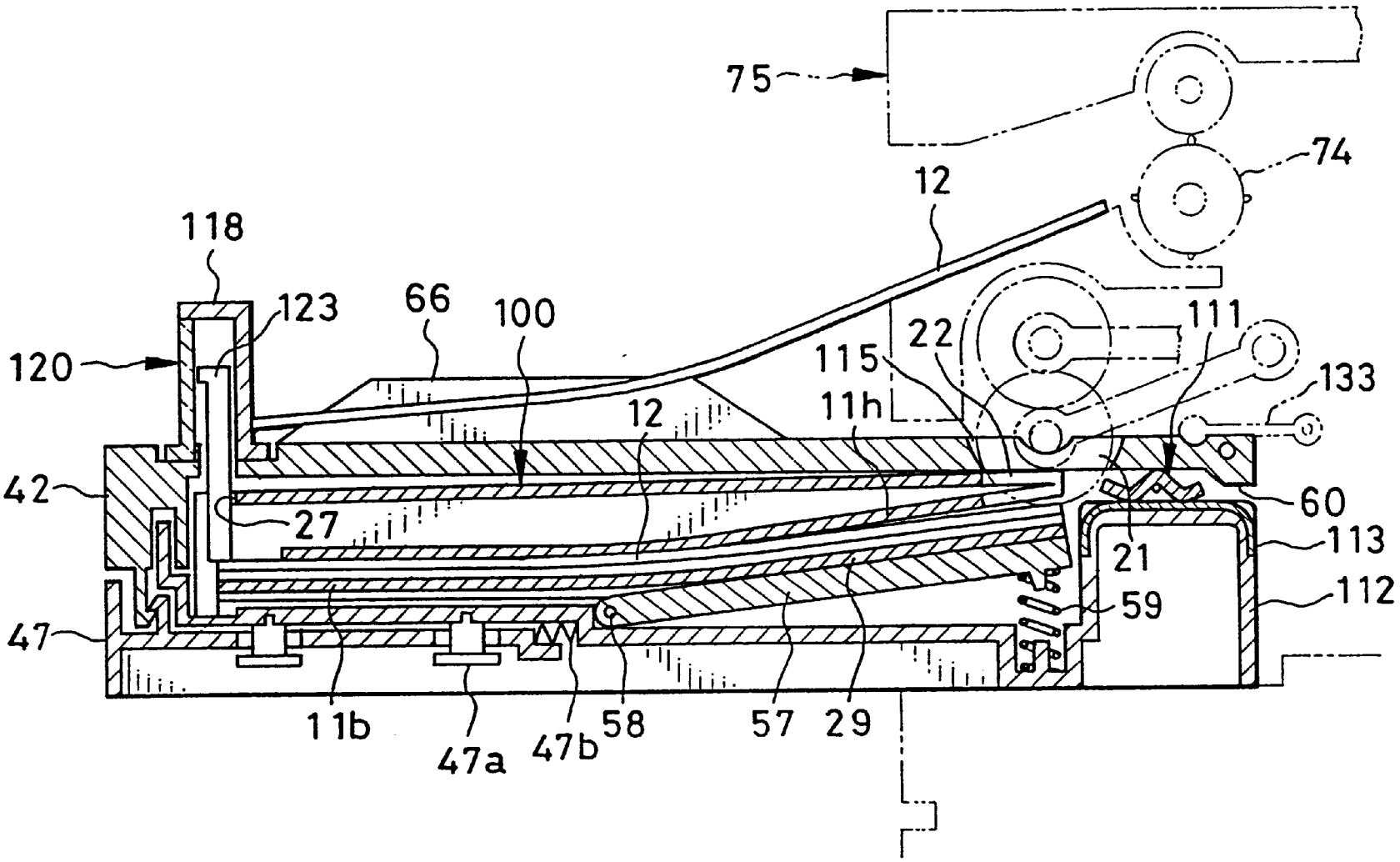
FIG. 19 is a vertical section illustrating the same as FIG. 18 but in which the remaining sheets are decreasing.

In FIGS. 17–19, a stopper wall 118 is provided with a sheet remainder counter 120, which appears in a face of the stopper wall 118 opposite to the cassette outlet 60, and indicates an amount of the remainder of the recording sheets 12.

Figure 20:
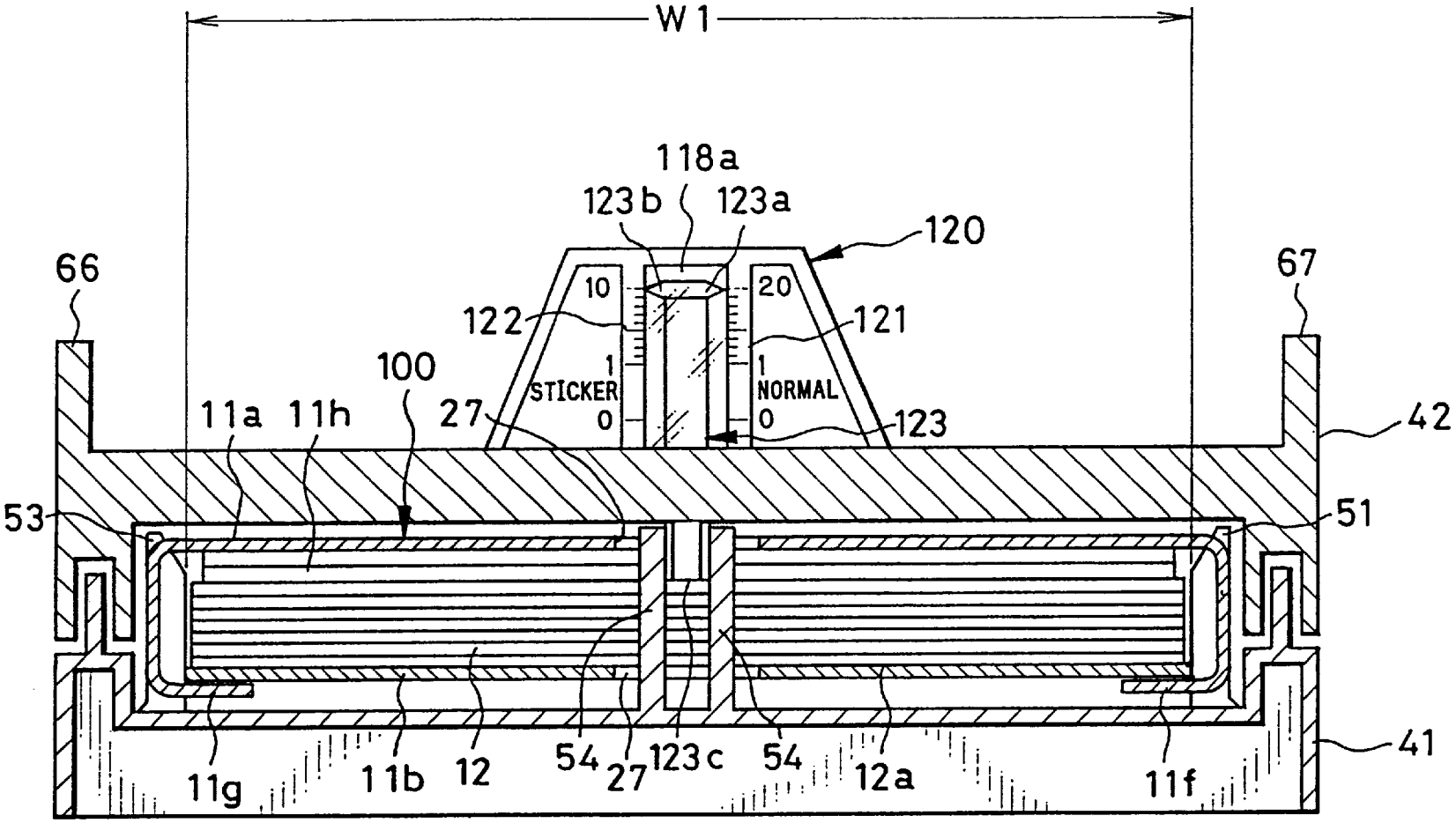
FIG. 20 is a cross section illustrating the sheet supply cassette containing the recording sheet package.

In FIG. 20, the sheet remainder counter 120 is constituted by gradation sign trains 121 and 122 and a pointer 123 for pointing the gradation sign trains 121 and 122. Pointer ends 123*a* and 123*b* are disposed on the top of the pointer 123. A transparent plate 118*a* or ultraviolet ray cut filter is disposed in front of the pointer ends 123*a* and 123*b* for the purpose of allowing external observation of the pointer ends 123*a* and 123*b*. Therefore, it is possible to avoid entry of ultraviolet rays into the sheet supply cassette 40 which are harmful to the coloring ability of the recording sheets 12.

The pointer 123 is disposed in a manner movable inside the stopper wall 118 in a thickness direction of the recording sheets 12. While the lid 42 is closed, the weight of the pointer 123 keeps its bottom end 123c in contact with an uppermost one of the recording sheets 12 through the cutout 27.

The gradation sign trains 121 and 122 are arranged in the right and left to the pointer 123. The gradation sign train 121 constitutes a scale for the recording sheets 12 of an ordinary type, and is "20" down to "0" (zero). The gradation sign train 122 constitutes a scale for thermal printing stickers having a greater thickness, and is "10" down to "0" (zero).

In FIG. 18, there is a click retainer member 133 for engagement with a clicking operation in order to keeping the sheet supply cassette 40 retained on the thermal printer without dropping.

Figure 21:
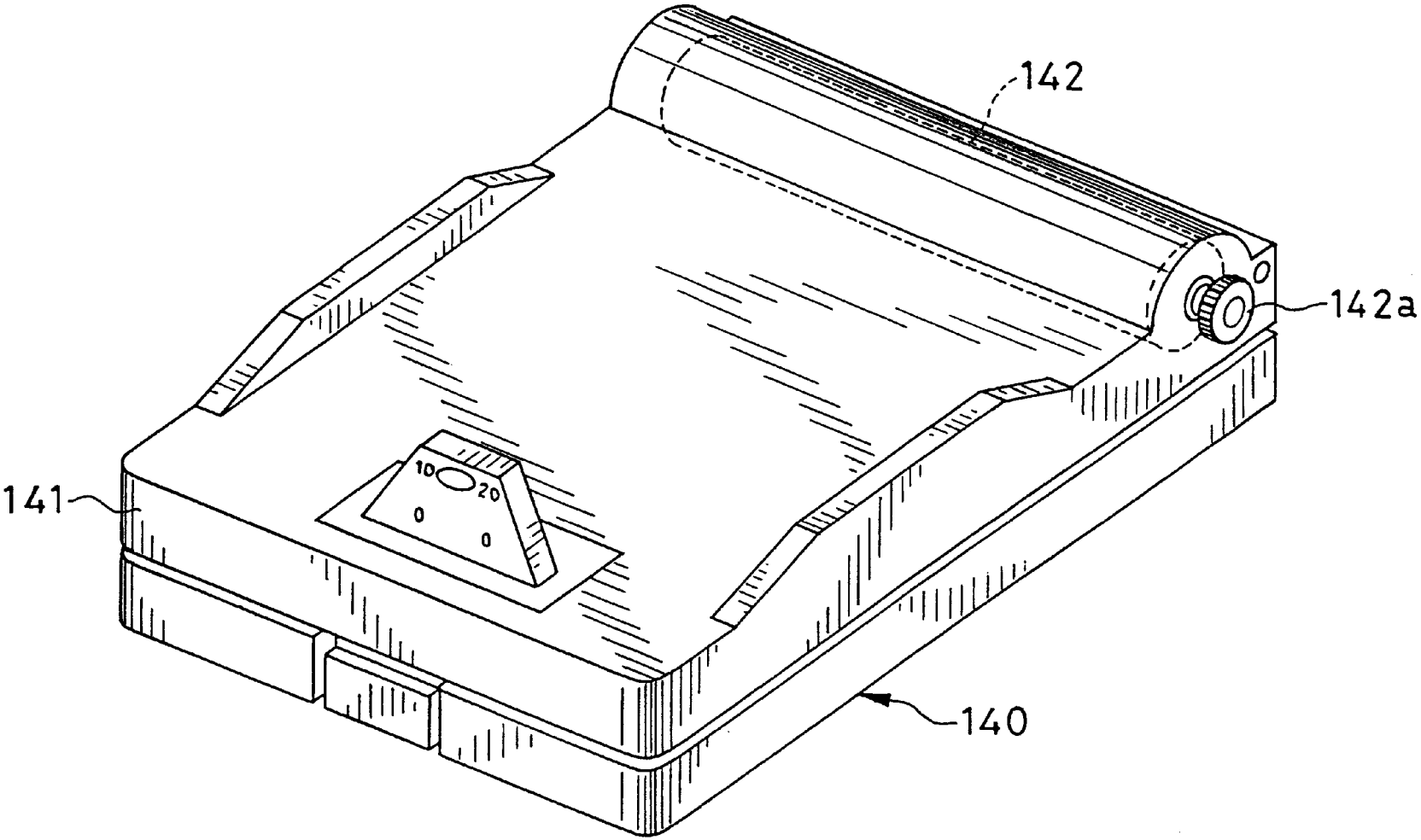
FIG. 21 is a vertical section illustrating still another preferred sheet supply cassette having a supply roller.

In FIGS. 17–19, insertion openings 115 according to the present embodiment are formed in the lid 42 for entry of the supply roller 21. Furthermore, a sheet supply cassette, as illustrated in FIG. 21, may include a supply roller 142 disposed in a lid 141 closing a cassette portion 140. A gear 142*a* may be associated with the supply roller 142, and driven to rotate by a mechanism in a thermal printer. The lid 141 does not have the insertion openings 115 according to FIG. 17. Thus the sheet supply cassette can have a more reliable light-shielded and moisture-shielded state. Note that the supply roller 142 in FIG. 21 consists of a single roller portion. Alternatively, a supply roller may be a multiple-roller type, including a shaft and a plurality of roller portions having a small width and an equal diameter and arranged in line and coaxially about the shaft. Also sponge members of an air-tight type can be disposed in joint edges of the cassette portion and the lid, to ensure the moisture-proofness and light-shielding ability.

Figure 22:
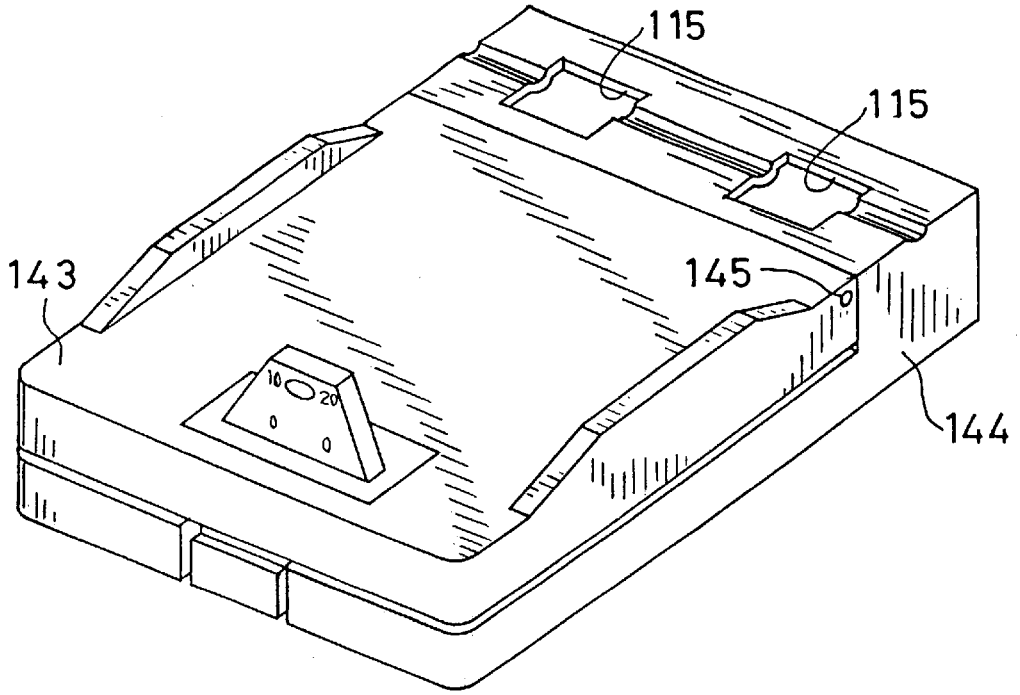
FIG. 22 is a perspective illustrating a different sheet supply cassette in which a lid has a smaller size.
Figure 23:
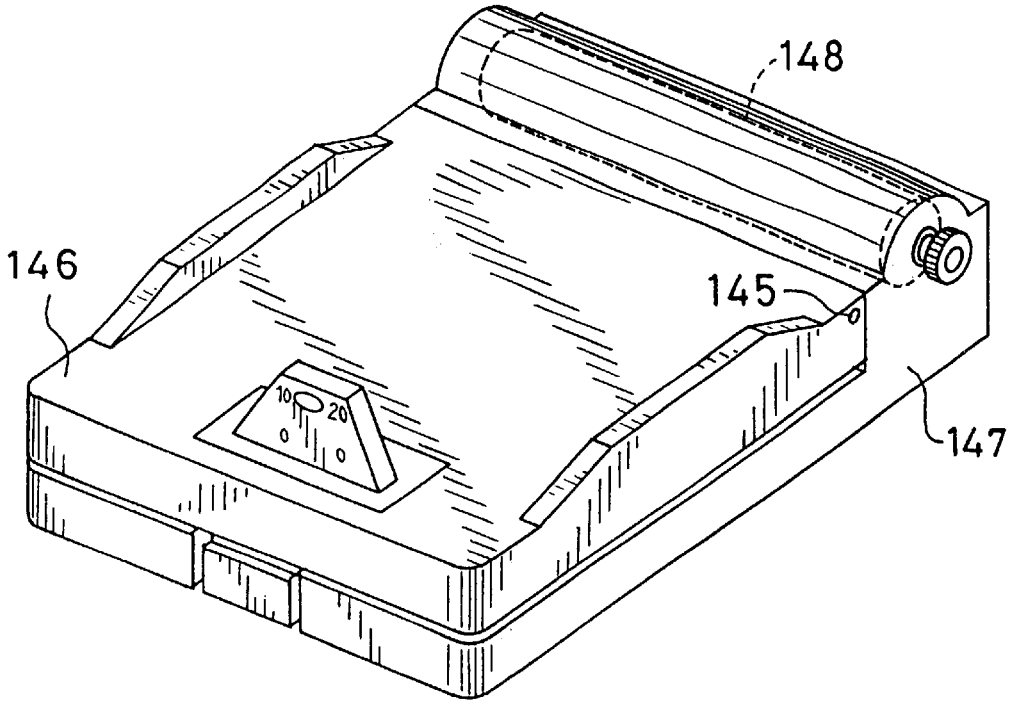
FIG. 23 is a vertical section illustrating a different sheet supply cassette having a supply roller.

In the above embodiment, the lid 42 has nearly the same size as that of the cassette portion 41. Alternatively a sheet supply cassette, as illustrated in FIG. 22, can be constructed with a lid 143 having a size enough to cover a part of a cassette portion 144. The lid 143 is disposed on the cassette portion 144 in an openable manner in connection with a pivot 145 or a hinge mechanism. The cassette portion 144 is provided with the insertion openings 115 formed therein. Furthermore, a sheet supply cassette of a roller-built-in type, as illustrated in FIG. 23, can be so constructed that a lid 146 has a size enough to cover a part of a cassette portion 147. Note that the cassette portion 147 is provided with a supply roller 148 supported in a rotatable manner therein.

In the above embodiments, the recording sheets 12 are loaded in the sheet supply cassette 40 in a state contained in the recording sheet package 100. However the package chamber 44 of a thermal printer may be loaded with the recording sheets 12 directly without the use of the packaging case 110.

In the above embodiments, the insertion openings 115 are formed through portions of the lid. Alternatively insertion recesses or gaps for insertion of the supply roller 21 may be formed in the lid by cutting its corners or portions along its edges.

In the above embodiments, the cassette body includes the cassette portion and the lid. Alternatively a cassette body may be a single inseparable member loadable in the loading opening of the printer, and may consist of a tray, plate or receptacle of any suitable type without a lid, or a box, drawer or holder of any suitable type having only one open end as the cassette outlet.

Figure 24:
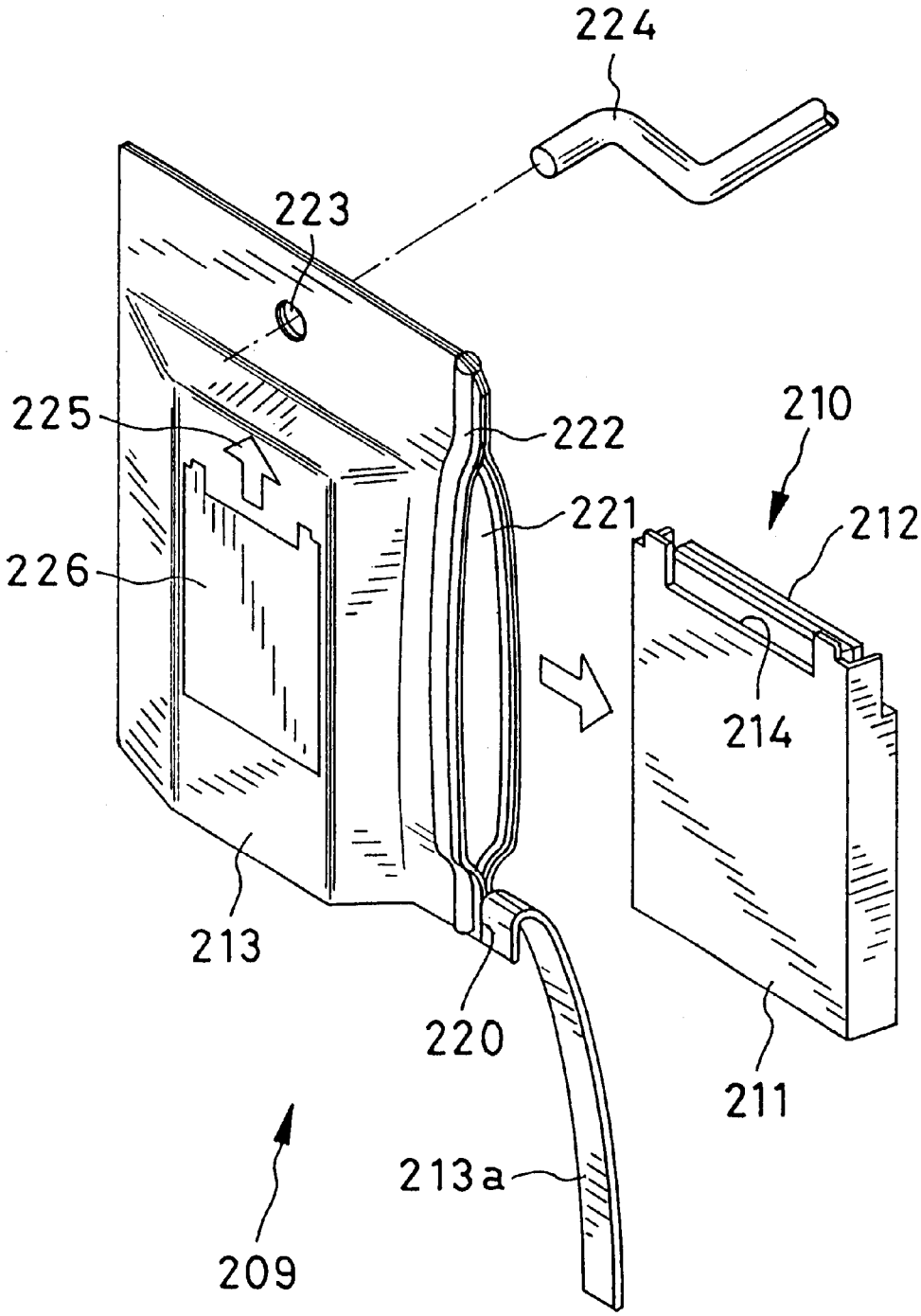
FIG. 24 is an exploded perspective illustrating a recording sheet package where a packaging case is being removed from an outer bag.
Figure 25:
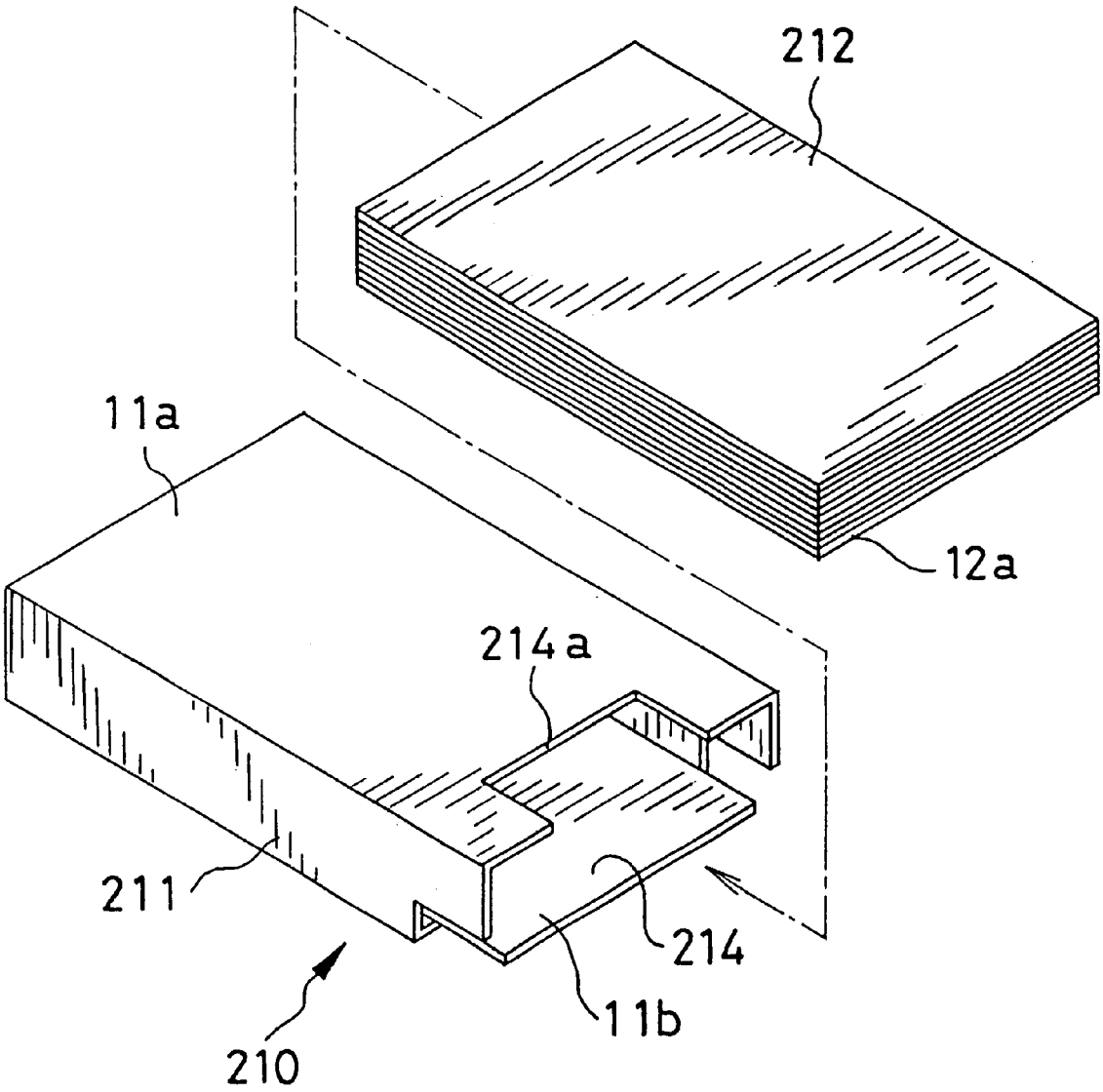
FIG. 25 is an exploded perspective illustrating the packaging case and recording sheets.

In FIGS. 24–33, other preferred recording sheet packages are described, in which packaging material can have suitability for protection of the recording sheets in the course of transportation and preservation. In FIG. 24, a recording sheet package 209 is constituted of a recording sheet cartridge 210 and an outer bag 213 for containing the recording sheet cartridge 210. In FIG. 25, the recording sheet cartridge 210 is constituted by a packaging case 211 or case and thermosensitive recording sheets 212 contained therein. The recording sheet cartridge 210 is formed from cardboard or paper, but may be formed from plastic material.

In FIG. 24, the outer bag 213 is used to contain the recording sheet cartridge 210 for retail sale, and has light-shielding and moisture-proof characteristics. To use the recording sheet cartridge 210, a vertical edge portion 213*a* of the outer bag 213 is torn away along a cutting line 220, to open the outer bag 213 along a cut edge 221. The outer bag 213 is produced from an aluminum-laminated sheet with the light-shielding and moisture-proof characteristics.

A first direction indicia 225 is printed on each of the front and rear surfaces of the outer bag 213, has a shape of an arrow, and is directed to a position of a package outlet 214 of the recording sheet cartridge 210. There is information printed on the surfaces of the outer bag 213 to represent the sheet type, the manufacturer name, notice to users and the like in relation to the recording sheets. A second direction indicia 226 is printed in a position under the first direction indicia 225, and is an image of the entirety of the recording sheet cartridge 210 with a reduced size. The second direction indicia 226 is also useful for recognizing the direction of the package outlet 214 in an apparent manner. It is to be noted that, instead of the use of both the direction indicia 225 and 226, only one of them may be printed without printing the remainder.

Figure 28:
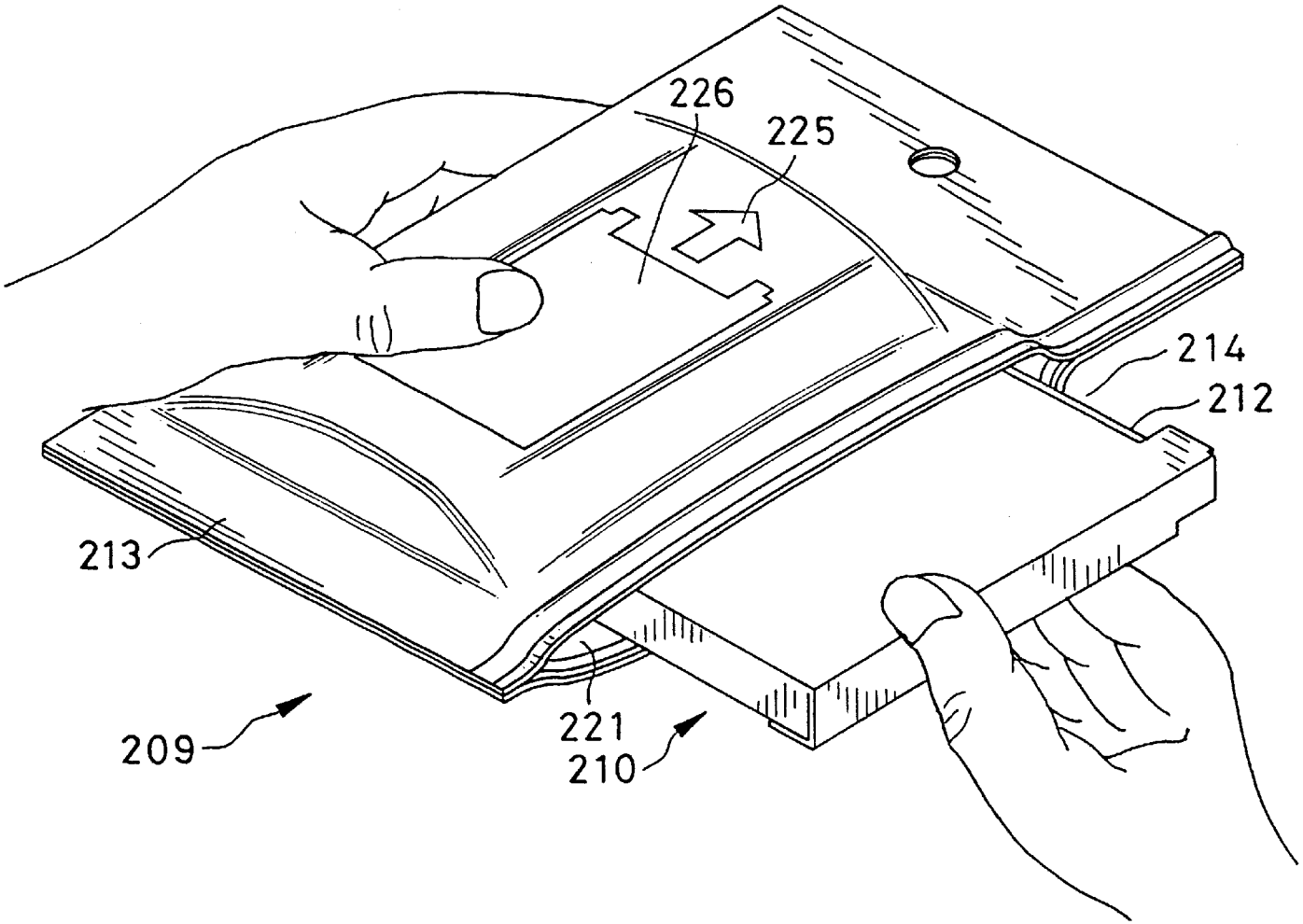
FIG. 28 is a perspective illustrating the same as FIG. 27 handled horizontally.
Figure 29:
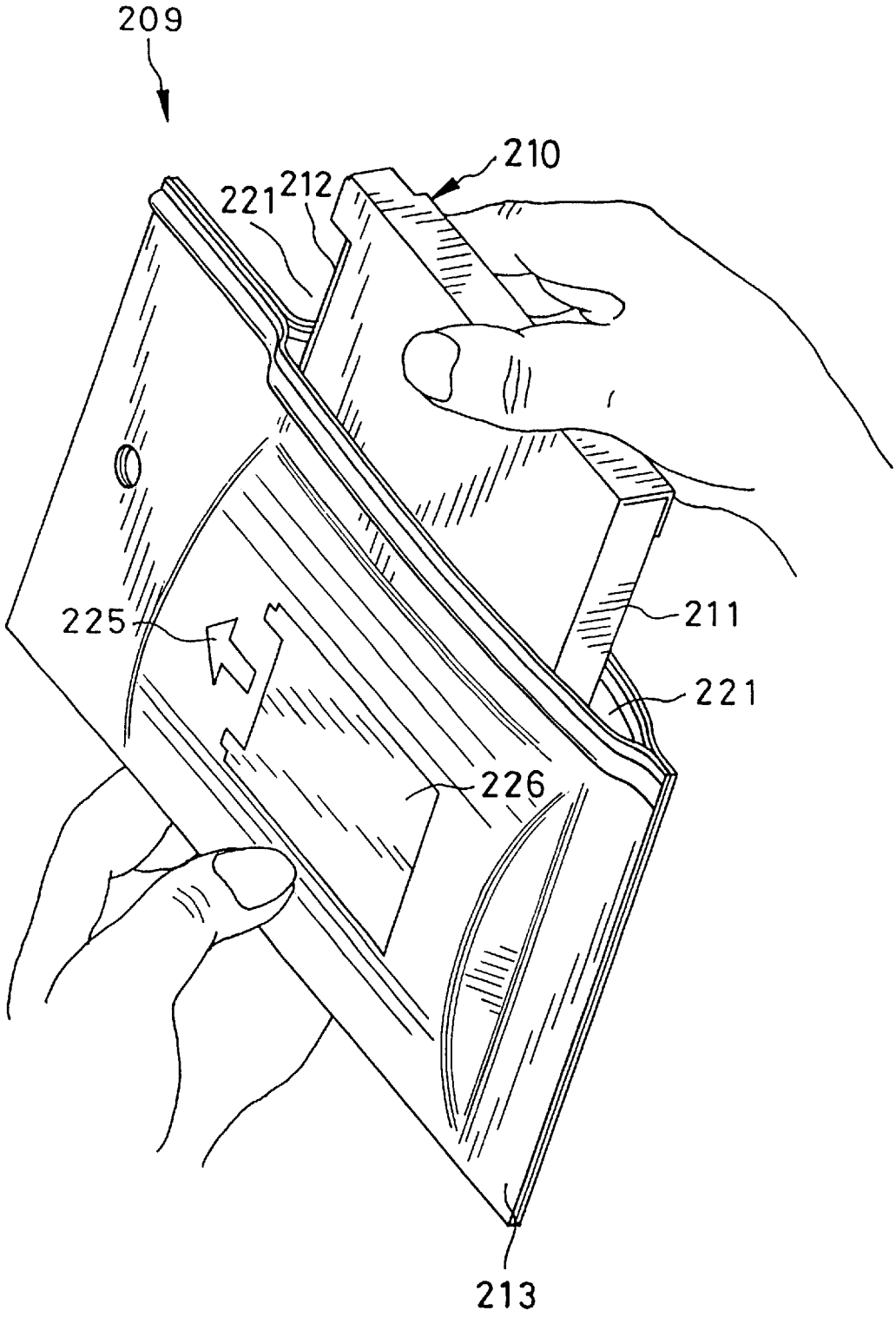
FIG. 29 is a perspective illustrating the same as FIGS. 27 and 28 but handled vertically.

To unseal the package, a user checks the direction indicia 225 and 226 for the orientation of the recording sheet cartridge 210, and keeps the package outlet 214 of the recording sheet cartridge 210 oriented exactly upwards or obliquely upwards when the vertical edge portion 213*a* is torn. In FIG. 28, the cut edge 221 is directed horizontally or obliquely upwards. In FIG. 29, the cut edge 221 is directed upwards. The recording sheet cartridge 210 is removed from the outer bag 213 while keeping the state of FIG. 28 or 29. The recording sheet cartridge 210 is set in the sheet supply cassette or thermal printer while the package outlet 214 is directed upwards to keep the recording sheets 212 from dropping out of the packaging case 211.

In FIG. 24, the recording sheet cartridge 210 is so oriented as to direct the package outlet 214 upward in the outer bag 213. A suspension hole 223 is formed in the top end of the outer bag 213. A suspension hook 224 is used in a store for commercial display, and suspends the outer bag 213 at the suspension hole 223. In the packaging case 211, the lower edges of the recording sheets 212 are kept aligned by the weight of the recording sheets 212. Therefore, it is unnecessary to neaten the edges of the recording sheets 212 when the recording sheet cartridge 210 is pulled out of the outer bag 213. The recording sheet cartridge 210 with the recording sheets 212 can be set in the thermal printer or sheet supply cassette easily.

Figure 30:
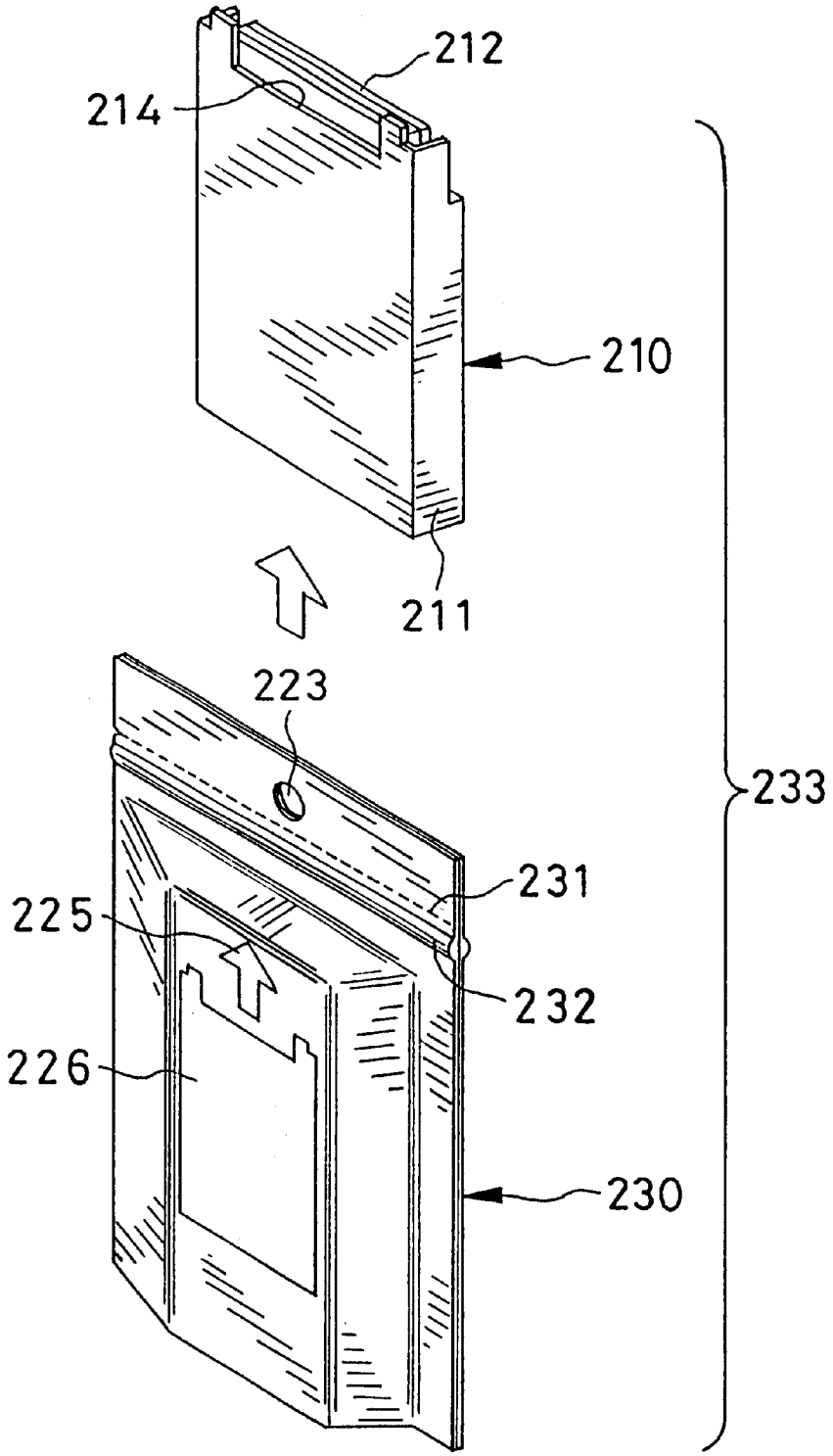
FIGS. 30–32 are exploded perspectives illustrating different preferred recording sheet packages.

A fastener 222 and the cutting line 220 according to the present embodiment are located along one of the vertical edges of the outer bag 213. Furthermore, a recording sheet package 233 or cartridge, as illustrated in FIG. 30, can have a cutting line 231 and a fastener 232 both along a top edge of an outer bag 230. The cutting line 231 has a cutting notch formed in the outer bag 230 at a point along the left vertical edge. Elements similar to those of the embodiment of FIG. 24 are designated with identical reference numerals.

Figure 31:
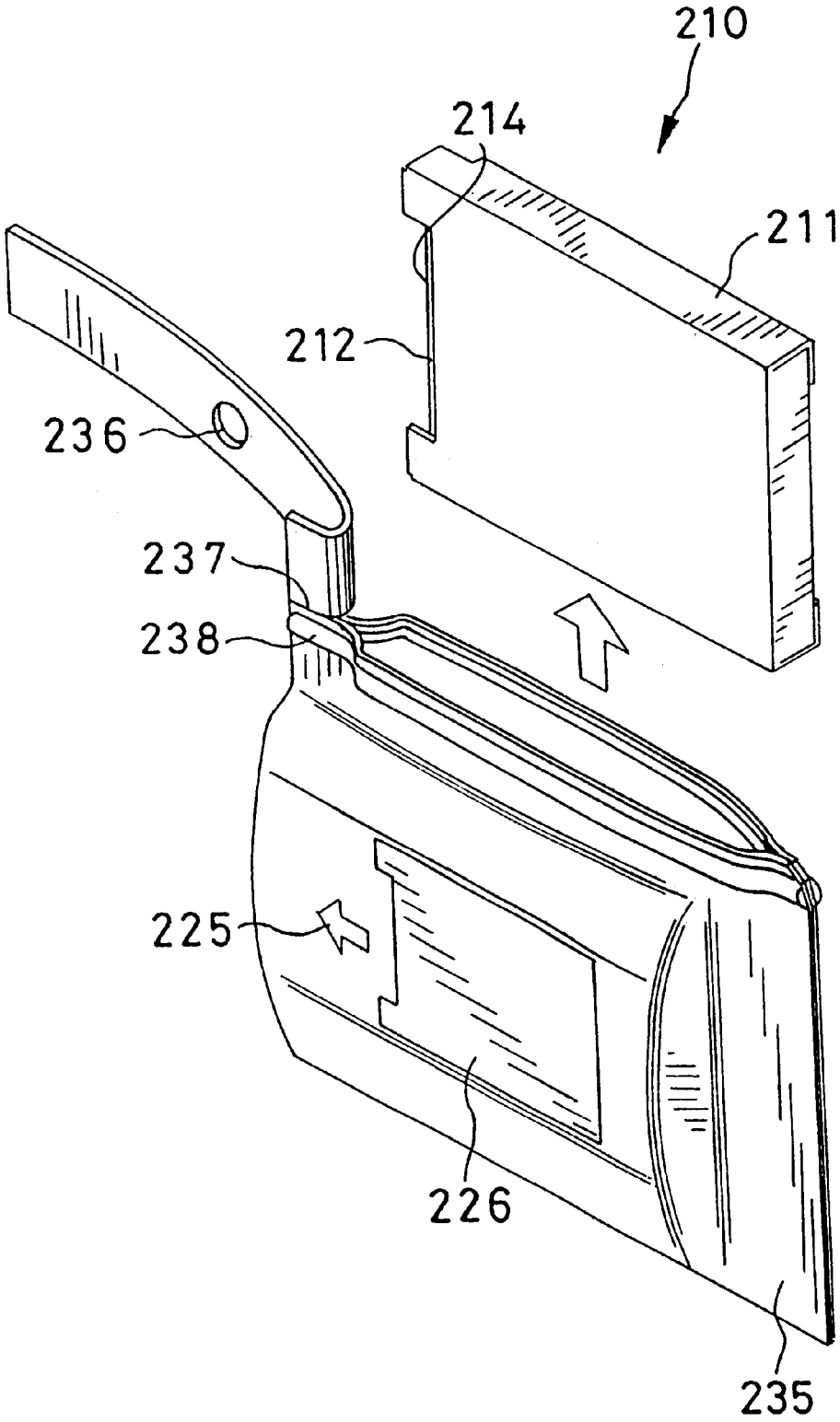

Furthermore, the recording sheet cartridge 210 may be oriented to direct the package outlet 214 horizontally while contained in an outer bag 235 as illustrated in FIG. 31. A suspension hole 236 is formed in a top edge of the outer bag 235. A cutting line at the top edge 237 is located under the suspension hole 236. A fastener 238 is located under the cutting line. The top edge 237 of the outer bag 213 is cut, before the fastener 238 is opened to remove the recording sheet cartridge 210 from the suspension hole 236. This construction is advantageous in that the outer bag 235 can be unsealed in a convenient orientation. There occurs no accident of dropping the recording sheet cartridge 210 out of the outer bag, or dropping the recording sheets 212 out of the packaging case 211.

Figure 32:
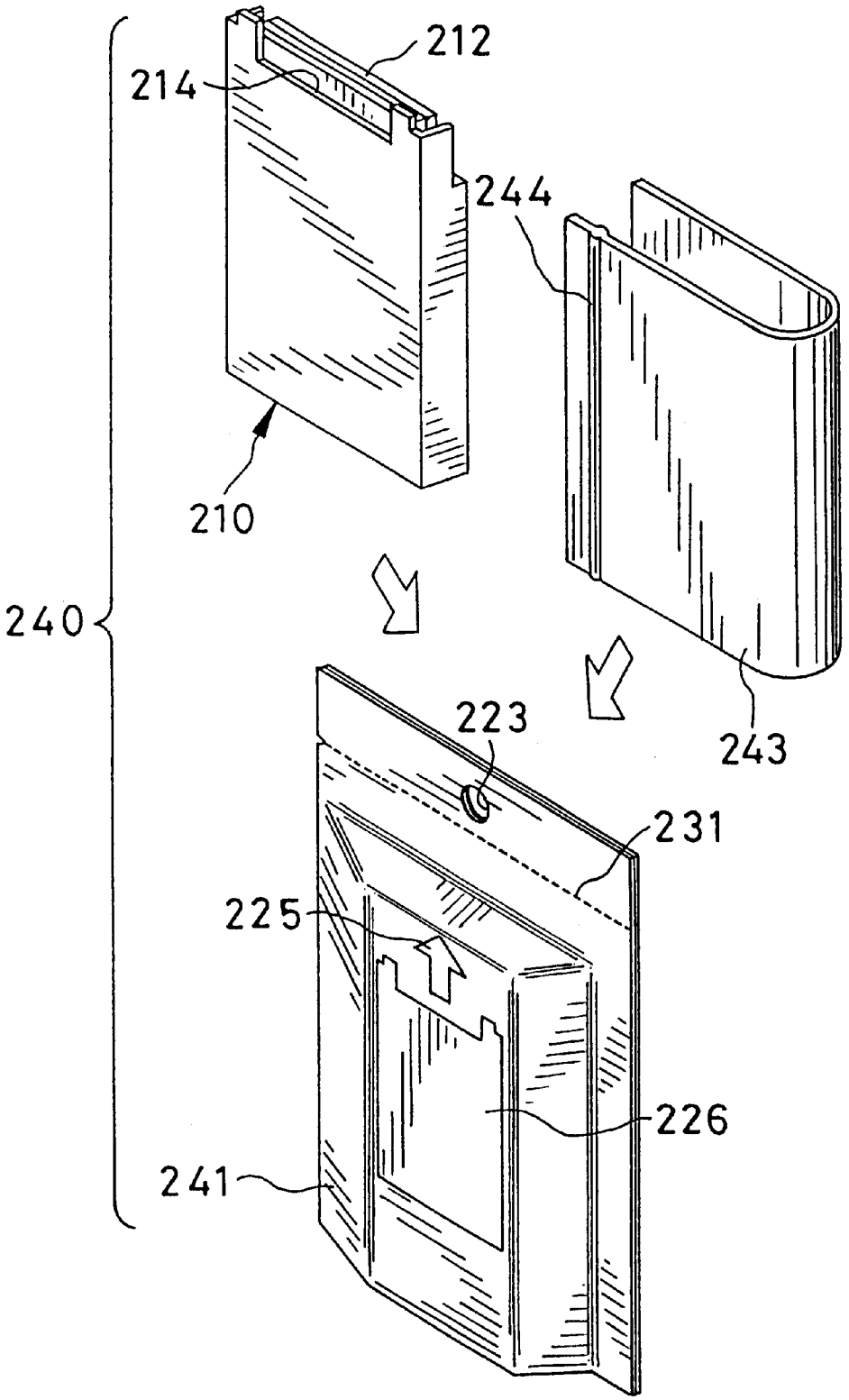

In spite of the above advantages of the embodiments, mass production of the fastener 222 is involved with difficulties particularly because of the use of the aluminum laminated sheet material for the outer bag 213. Or else the moisture shielding ability of the outer bag 213 may become low if there is no effective structure for reliably closing the outer bag 213. In view of this, a recording sheet package 240 in FIG. 32 is constructed with suitability for mass production and moisture shielding ability. The recording sheet package 240 is a combination of a light-tight outer bag 241, the recording sheet cartridge 210 and a protection bag 243. The protection bag 243 is initially folded in two halves, roughly wraps the recording sheet cartridge 210, and preinserted into the outer bag 241 before being enclosed for shipment. The protection bag 243 is provided with a fastener 244, and is produced from polyethylene terephthalate (PET), the use of which is advantageous because of a low manufacturing cost even with the fastener 244. A user, after unsealing the recording sheet package 240, uses the recording sheet cartridge 210 partially, and may wish to preserve the recording sheet cartridge 210 before being used completely. It is possible to accommodate the recording sheet cartridge 210 into the protection bag 243, close the fastener 244, tightly envelop the recording sheet cartridge 210 in the fastener 244, then insert them into the outer bag 241. Thus the recording sheets 212 can be preserved in the light-shielded and moisture-shielded state. This embodiment is effective in reducing the cost of the recording sheet package 240 because of the use of the elements available as products of mass production.

Figure 26:
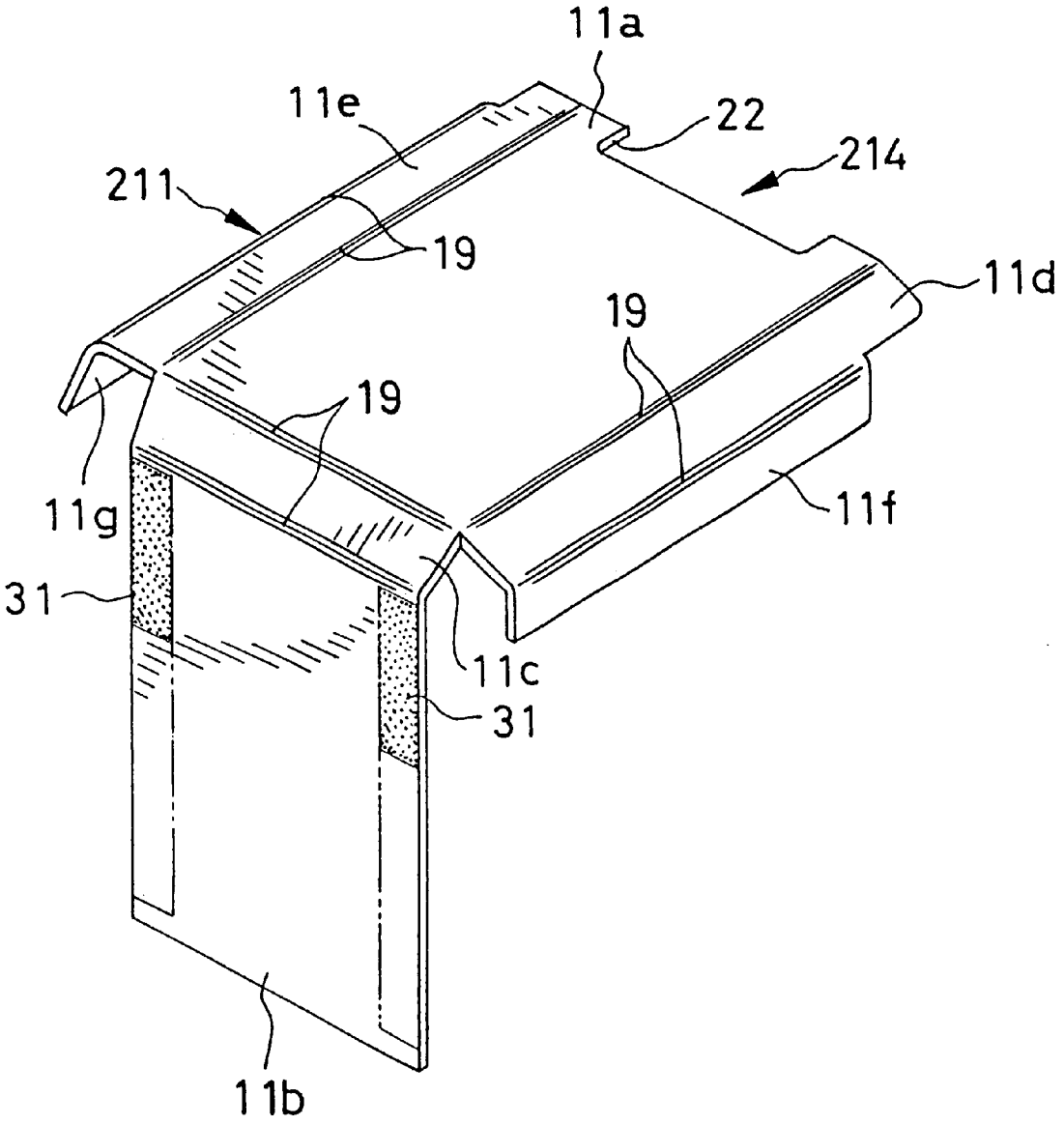
FIG. 26 is a perspective illustrating a spread state of the packaging case.
Figure 27:
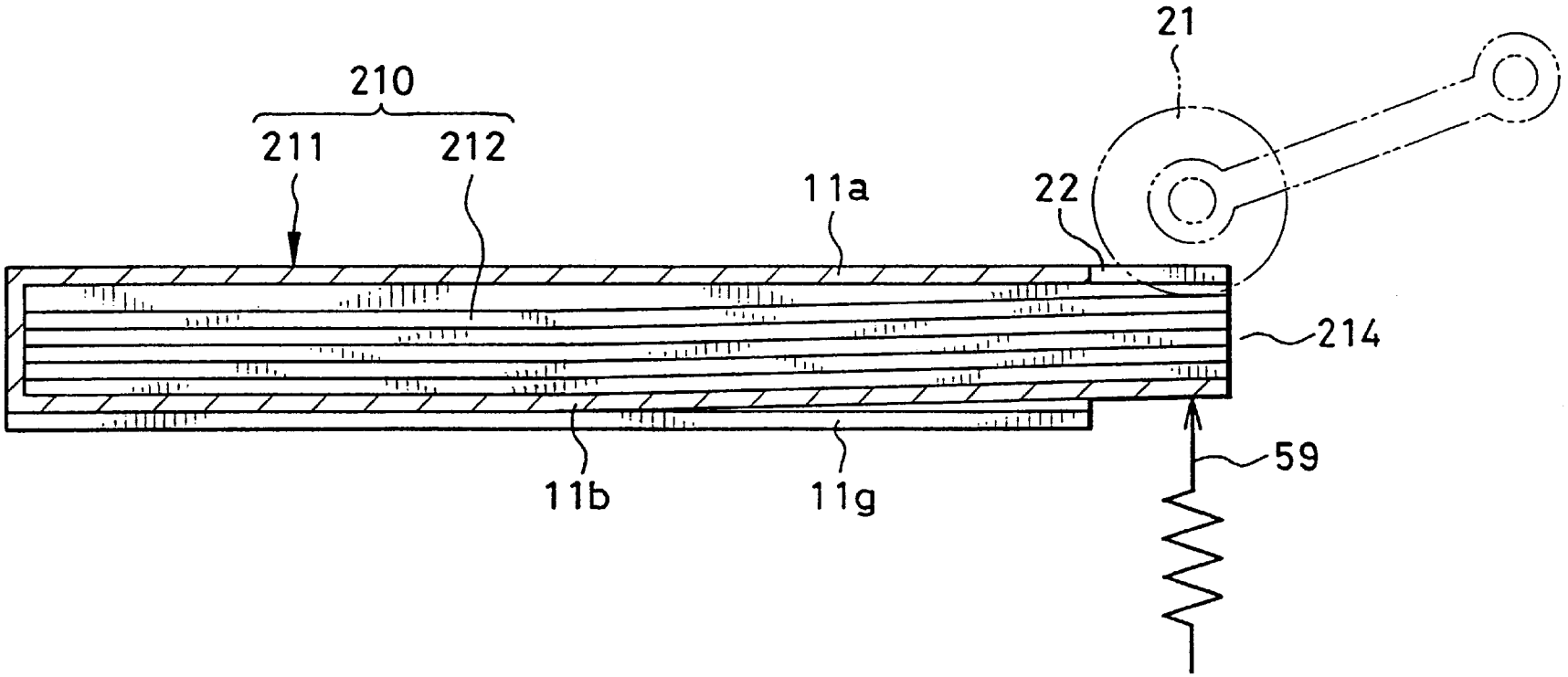
FIG. 27 is a vertical section illustrating the recording sheet cartridge.

In the above embodiments, the suspension hole 223, 236 is formed in the outer bag 213. Alternatively, a suspension hook (not shown) may be formed with an outer bag. In FIG. 26, the packaging case 211 is in a thin box shape, and has one open end having the package outlet 214. However the push plate 11*h* can be connected with the top plate 11*a* along a bend line 251 in a packaging case 250 of FIG. 33. A roller receiving slot 249 is formed in the packaging case 250. Elements similar to those of FIG. 26 are designated with identical reference numerals. The push plate 11*h* is bent at an angle of approximately 180 degrees via the bend line 251 to lie under the top plate 11*a*. The push plate 11*h* biases the recording sheets 212 toward the bottom plate 11*b* in the state contained in the packaging case 250, so the recording sheets 212 are contacted tightly on one another.

Figure 33:
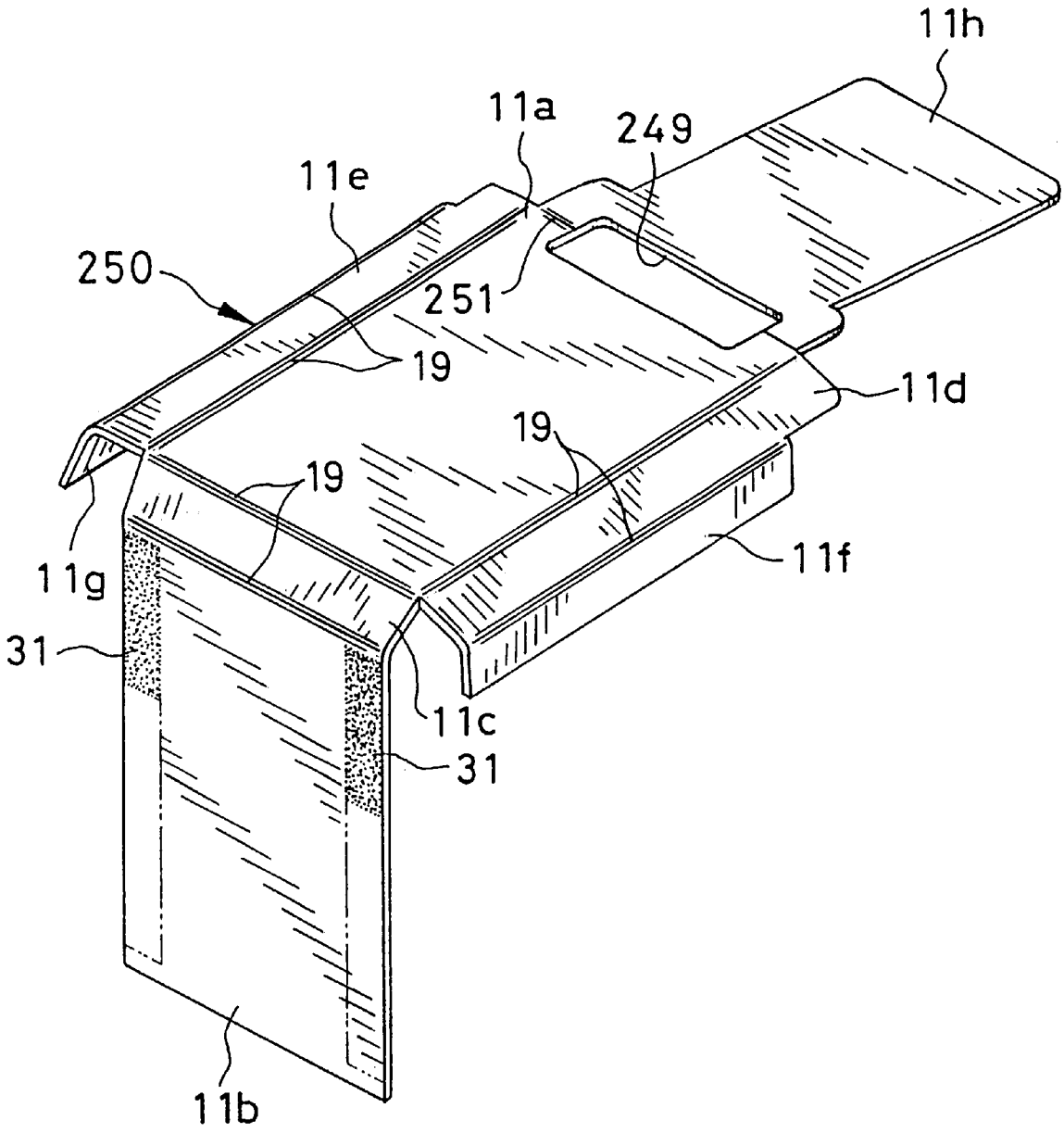
FIG. 33 is a perspective illustrating a spread state of a packaging case.

Instead of the packaging case 250 of FIG. 33, the packaging case 110 of FIG. 16 may be packaged as illustrated in FIGS. 24–32. The packaging case 110 is nearly the same as the packaging case 250, but includes the cutouts 23–27. In the loading into the thermal printer or the sheet supply cassette, guiding members are inserted into the packaging case 110 through the cutouts 23–27, and neatly set the recording sheets 212 of the packaging case 110 in the sheet supply position. Even though the recording sheets 212 are loosely contained in the packaging case 110, setting of the recording sheet package in the sheet supply cassette automatically tightens the recording sheets 212 in the supply direction.

Furthermore, a roll type of a continuous recording sheet may be packaged in a recording material package according to the present invention.

The fastener 16, 222, 232, 238, 244 is produced from plastic material and includes a combination of the ridges. Also any type of fastener may be used, that can be opened and closed manually with ease, and repeatedly without being broken, and can close the bag in a manner reliably tight to water, air or the like.

In the above embodiments, the cutting line 15, 220, 231 has an end at which the cutting notch is formed by previously cutting an edge of the bag in a triangular shape with a sharp angle. The cutting notch is used for initially tearing the edge of the bag, and facilitates the cutting along the cutting line. However a cutting line in the present invention may have no cutting notch. It is possible to use any one of forms of cutting lines, including a train of perforations for facilitating cutting, a partially thinned line formed by cutting the bag sheet half as deep as its thickness, a simply printed line only indicating a position suitably for cutting of the bag, and the like.

Figure 34:
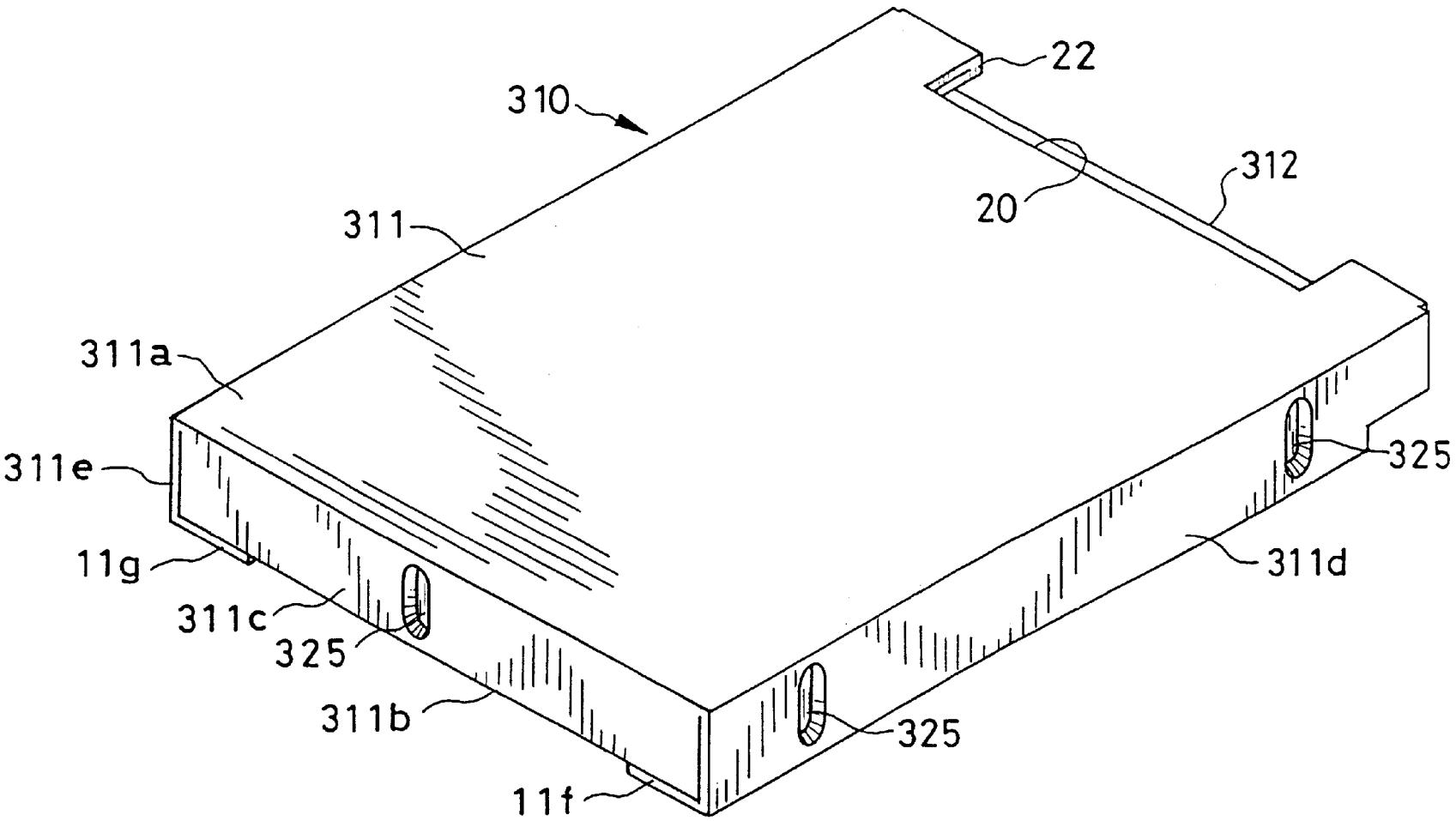
FIG. 34 is a perspective illustrating still another preferred recording sheet cartridge or package having position setter projections.
Figure 35:
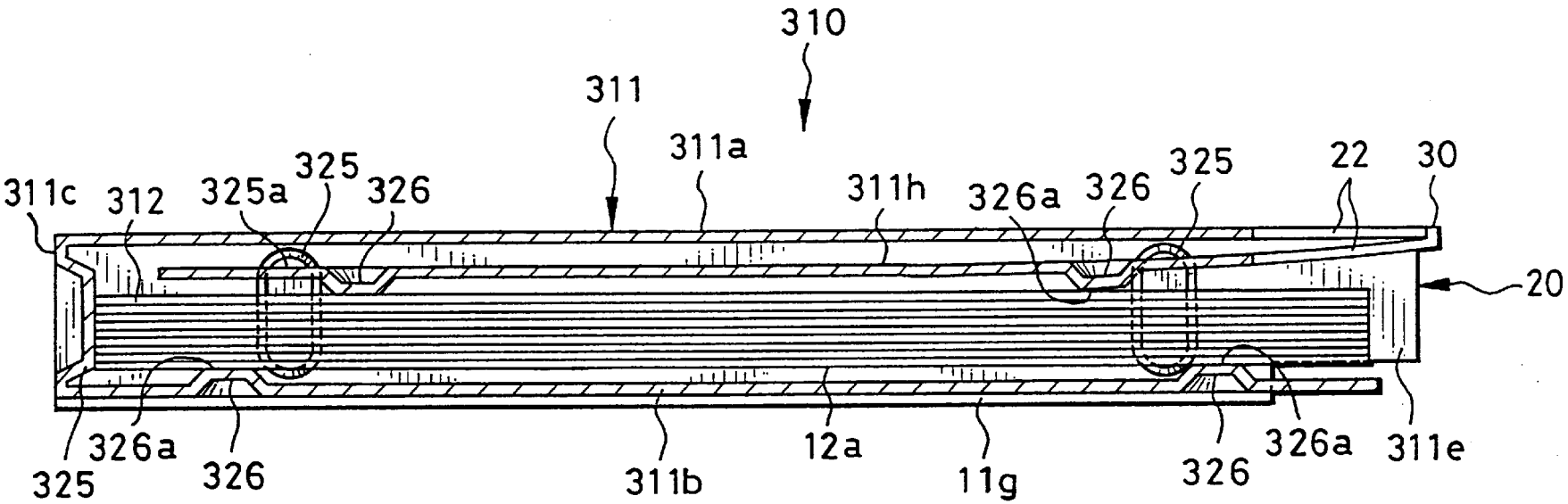
FIG. 35 is a vertical section illustrating the recording sheet package of FIG. 34.
Figure 36:
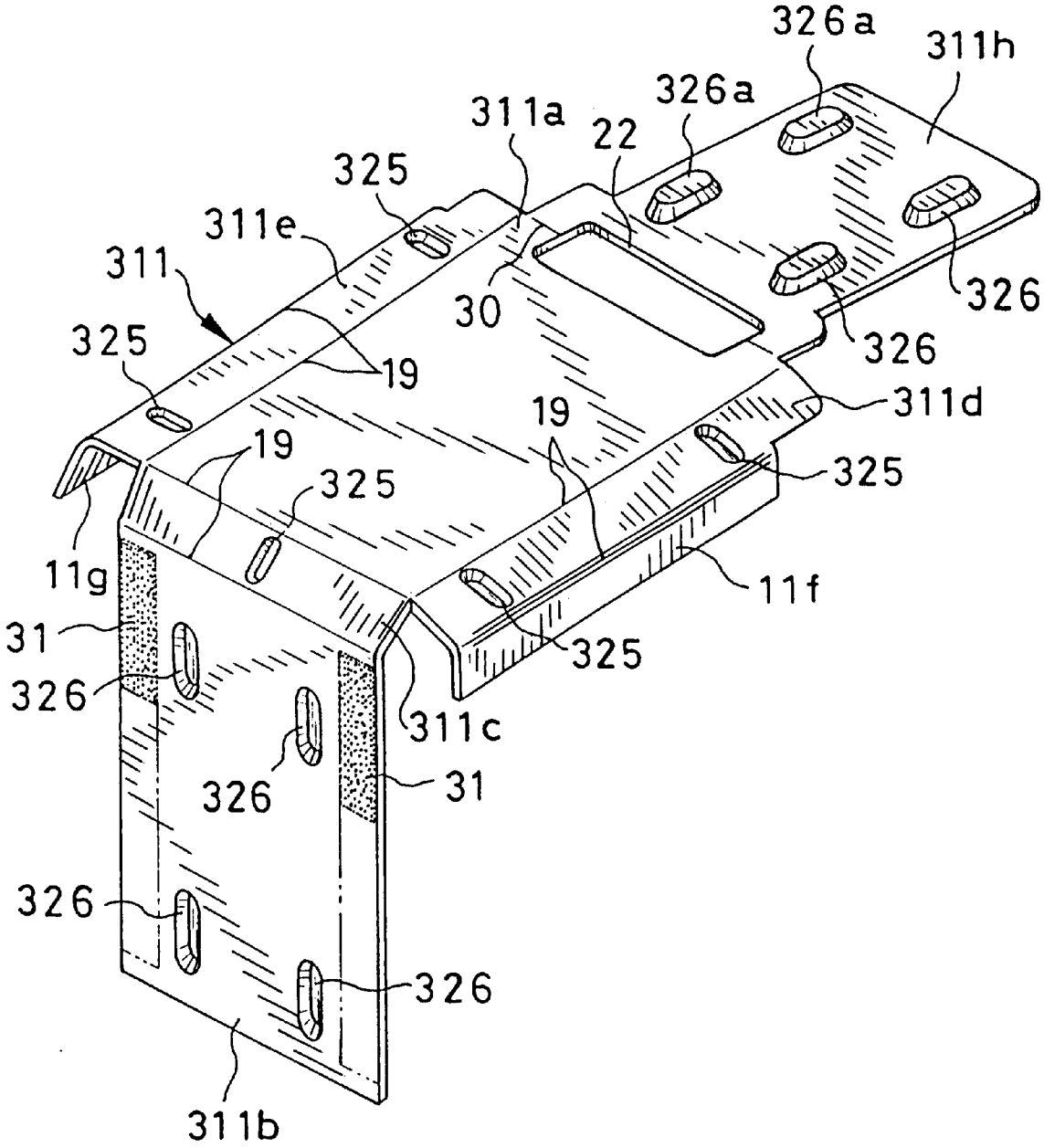
FIG. 36 is a perspective illustrating a spread state of a packaging case.
Figure 37:
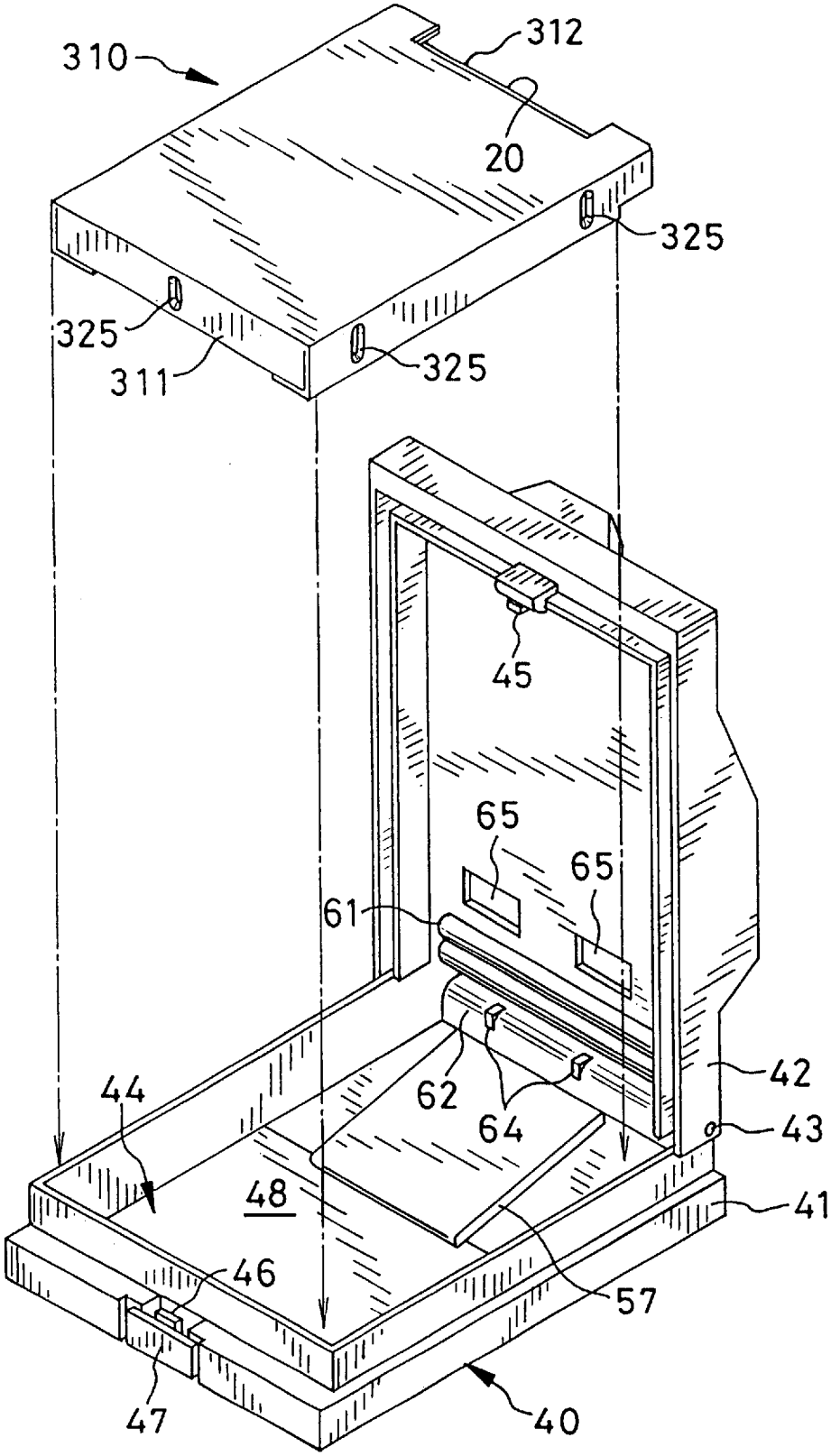
FIG. 37 is a perspective illustrating the sheet supply cassette and the recording sheet package.
Figure 38:
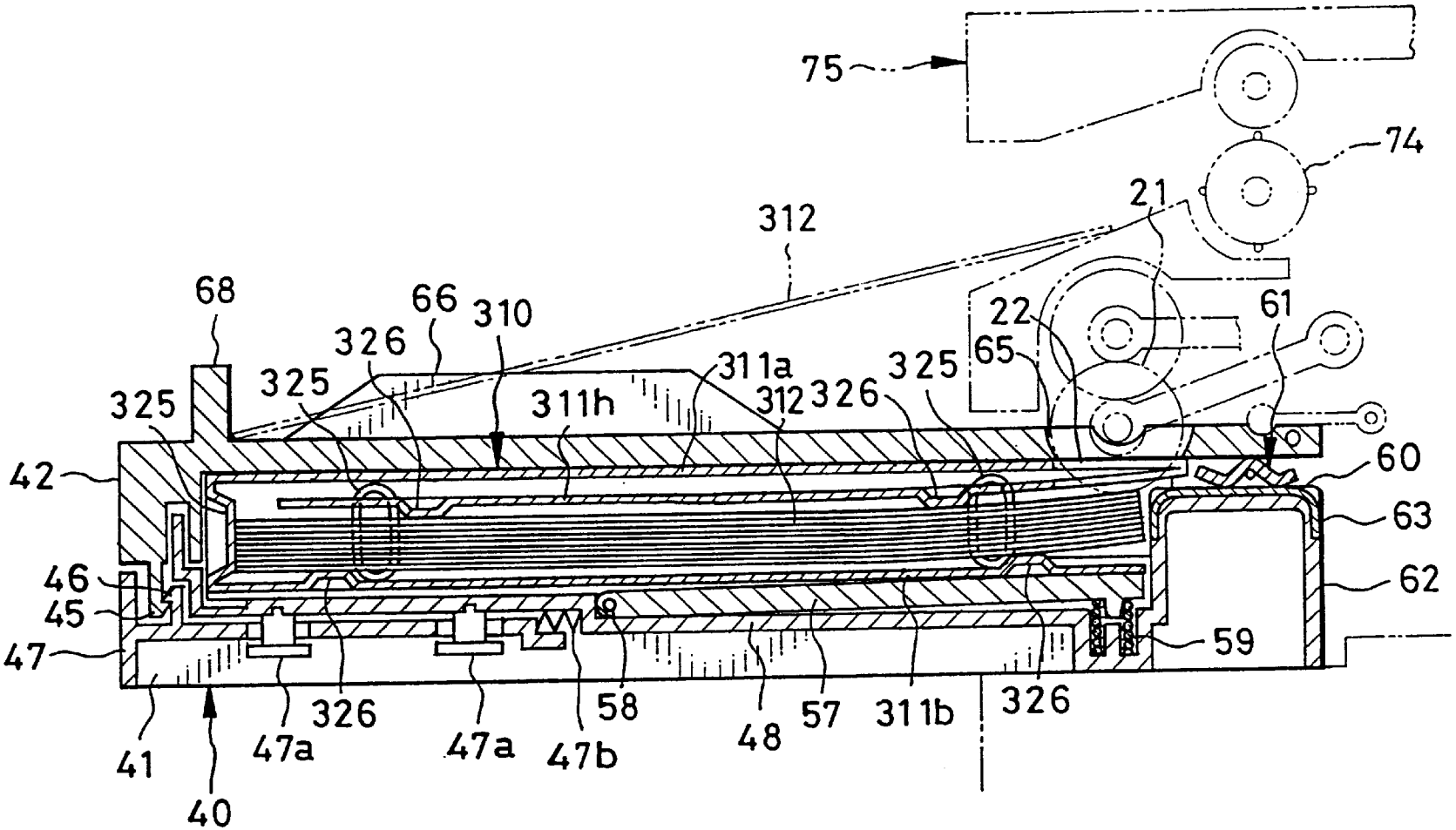
FIG. 38 is a vertical section illustrating the sheet supply cassette at the loading opening of the thermal printer.

In FIGS. 34–42, still other preferred embodiments are described, in which position setter structures are used to regulate the position of recording sheets. In FIGS. 34 and 35, a recording sheet package 310 or cartridge is constituted of a packaging case 311 and thermosensitive recording sheets 312.

Although a top plate 311*a* has a flat shape, there are position setter projections 325 and 326 formed to project over a bottom plate 311*b*, an end plate 311*c*, lateral plates 311*d* and 311*e*, and a push plate 311*h* and formed by embossing. The shape of the position setter projections 325 and 326 is elliptical or oval, and may be a form of any suitable loop. The position setter projections 325 and 326 have flat projection tops 325*a* and 326*a*, which push the recording sheets 312. Thus the recording sheets 312 are kept positioned inside the packaging case 311 without deviation. The recording sheets 312 are squeezed between the push plate 311*h* and the bottom plate 311*b*, and kept in contact with one another. Thus there is little external moisture coming to the recording surface of the recording sheets 312, which can be shielded from moisture with further effectiveness.

In the above embodiments, the position setter projections 325 and 326 are elliptical and have the projection tops 325*a* and 326*a* being flat. Furthermore, it is possible to form position setter projections in various shapes, for example, a frustum of a cone, a frustum of a pyramid and the like. Such position setter projections may have a shape of a circle, a quadrilateral, any polygon, a cross, a combination of a quadrilateral and a pair of two semicircles, and so forth.

Figure 39:
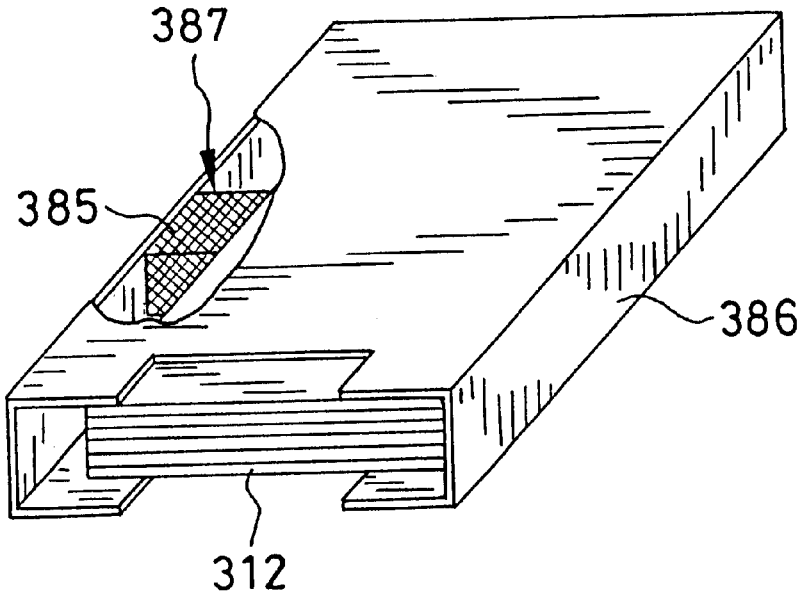
FIGS. 39 and 40 are perspectives illustrating recording sheet packages having another preferred position setter.
Figure 40:
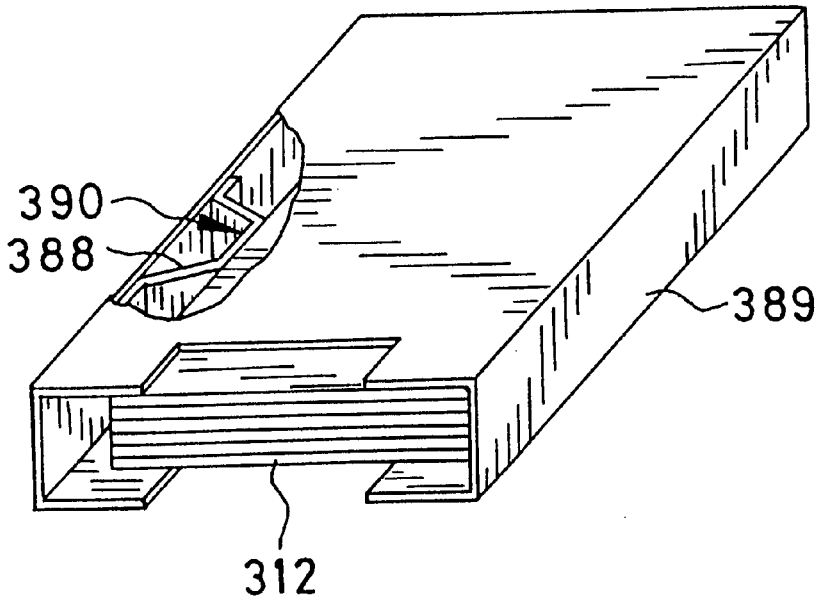

Instead of using the position setter projections 325 and 326, a packaging case 386 can have a position setter 387 in FIG. 39. The position setter 387 is constituted by a cushioning material 385, which is attached to an inside of the packaging case 386. The cushioning material 385 exists in one position on one of the lateral plates of the packaging case 386. Of course it is possible to arrange a plurality of cushioning materials 385 on a bottom plate, an end plate and a push plate of the packaging case 386 in the same manner as the position setter projections 325 and 326 of FIG. 36. Furthermore, as illustrated in FIG. 40, a packaging case 389 can have a position setter 390 constituted by a bracket 388, which may be paper or plastic. Also a packaging case can have a position setter constituted by a projection (not shown) as a portion of the packaging case. To define such a portion, an inside portion of the packaging case 389 may be cut and bent up in an inward direction.

Figure 41:
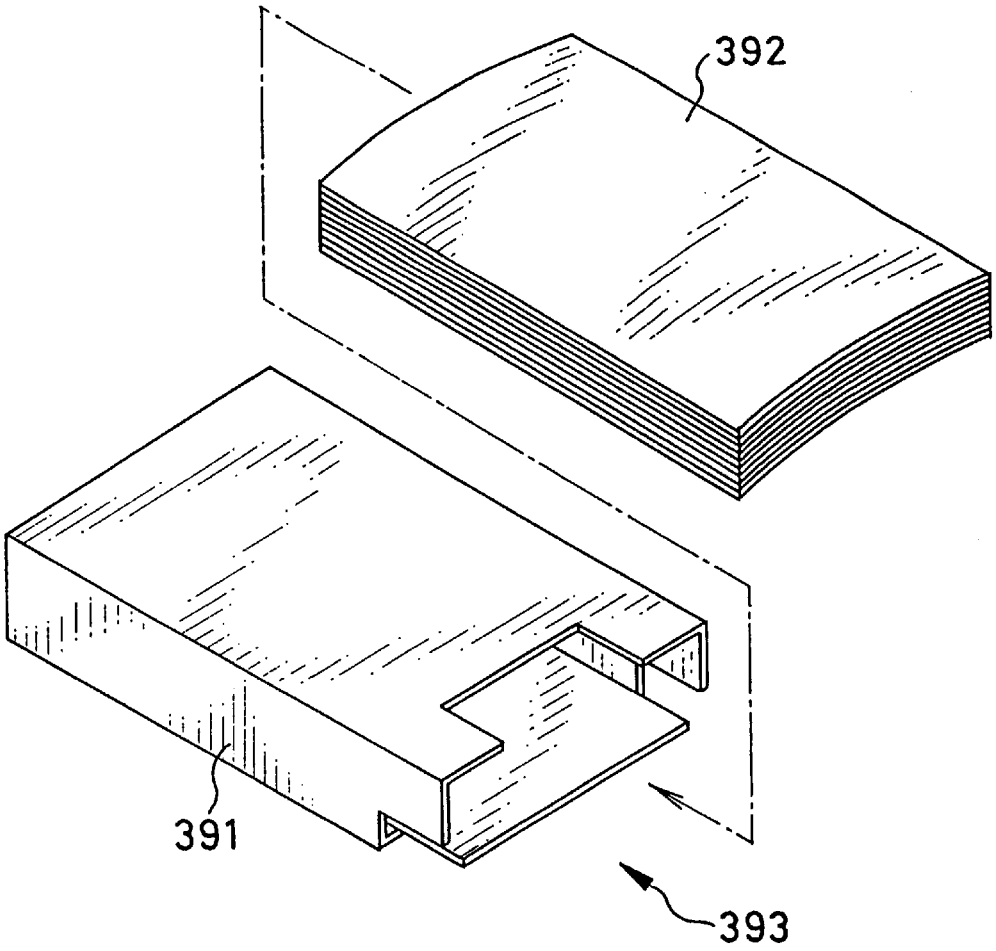
FIG. 41 is an exploded perspective illustrating another preferred packaging case and recording sheets.
Figure 42:
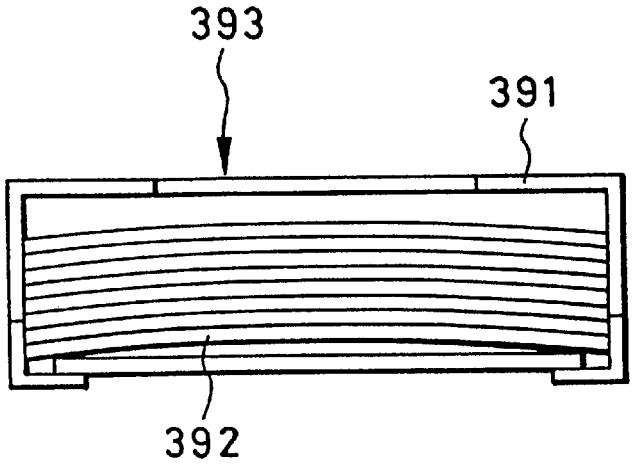
FIG. 42 is a front elevation illustrating a recording sheet package according to FIG. 41.

In FIG. 41, another preferred recording sheet package 393 or cartridge is illustrated. The recording sheet package 393 is constituted by a packaging case 391 and thermosensitive recording sheets 392. The packaging case 391 has a width smaller than that of the recording sheets 392, which are curved while contained in the packaging case 391. Lateral walls of the packaging case 391 forcibly keep the recording sheets 392 curved as illustrated in FIG. 42. Force of the recording sheets 392 to recover their flat shape positions the recording sheets 392 inside the packaging case 391, so that the recording sheets 392 do not have deviations inside the packaging case 391. In the course of manufacture of the recording sheet package 393, the recording sheets 392, after being stacked, are curved and, for the their insertion into the packaging case 391, kept at a width slightly smaller than that of the packaging case 391, as illustrated in FIG. 41. Therefore, the recording sheets 392 can be inserted in the packaging case 391 with great ease.

In the present invention, the recording sheets to be packaged may be a sublimation type, a wax-transfer type or any of other various types.

In the above embodiments, the sheet supply cassette is used for the thermal printer. Also the sheet supply cassette in the present invention may be constructed for use with an instant camera for taking instant photographs, or a duplicator machine, a telefacsimile machine or any machine for producing hard copies in any form with recording sheets. In the above embodiments, the recording sheets are color thermosensitive recording material. Furthermore, recording material in the present invention may be widely used simple paper called PPC paper, monochromatic thermosensitive recording material, photosensitive recording material, or the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording sheet package adapted for use with a printer, the printer including a printer component for image recording to a recording sheet, a loading opening through which the printer component is supplied with said recording sheet, and at least one guiding member for positioning said recording sheet in the loading opening, said recording sheet package comprising:

a packaging case for containing a loose stack of plural recording sheets preloaded in factory, said packaging case which is adapted to be loadable in the loading opening;

a package outlet, formed in said packaging case, passable to one of said recording sheets, and adapted to be directed toward the printer component;

at least one cutout, formed in a periphery of said packaging case, adapted to receive the guiding member; and at least one blocking mechanism, disposed inside said packaging case, for closing said cutout, said blocking mechanism being adapted to be shiftable inwards from said cutout by the guiding member.

2. A recording sheet package as defined in claim 1, wherein said blocking mechanism has a channel shape as viewed in section, and includes first, second and third portions arranged serially in connection with one another, said first and third portions are opposed to one another, a portion of said recording sheets is located between said first and third portions, and a space is defined between said second portion and said recording sheets.

3. A recording sheet package as defined in claim 2, further comprising:

an attaching plate attached to an inner face of said packaging case; and a deformable portion, disposed to extend from said attaching plate toward said cutout, for keeping said blocking mechanism positioned at said cutout, said deformable portion being resiliently deformed when said blocking mechanism is pushed through said cutout, and allowing said blocking mechanism to shift into said packaging case.

4. A recording sheet package as defined in claim 3, wherein said at least one cutout is plural cutouts, and said at least one blocking mechanism is plural blocking members.

5. A recording sheet package adapted for use with a printer, comprising:

a packaging case having two sides and two ends, for containing a stack of plural recording sheets preloaded in factory, the packaging case adapted to be disposed in the printer;

a package outlet, formed in one of said two ends of said packaging case, and passable to one of said recording sheets; and a position setter, disposed between an inside of said packaging case and said recording sheets, for preventing said recording sheets from being loose inside said packaging case, said recording sheet package being adapted to be used in a printer, the printer including a printer component for image recording to said recording sheets, and a loading opening through which the printer component is supplied with said recording sheets, and at least one guiding member for positioning said recording sheets in the loading opening;

said recording sheet package further comprising at least one cutout, formed in a periphery of said packaging case, and adapted to receive the guiding member;

wherein said position setter closes said cutout, and is adapted to be shiftable inwards from said cutout by the guiding member.

* * * * *